US010898994B2

(12) United States Patent
Carrier et al.

(10) Patent No.: US 10,898,994 B2
(45) Date of Patent: Jan. 26, 2021

(54) LIFT MECHANISM FOR FRAMING NAILER

(71) Applicant: Kyocera Senco Industrial Tools, Inc., Cincinnati, OH (US)

(72) Inventors: Alexander L. Carrier, Cincinnati, OH (US); Christopher D. Klein, Cincinnati, OH (US); Thomas A. McCardle, Mt. Healthy, OH (US)

(73) Assignee: Kyocera Senco Industrial Tools, Inc., Cincinnati, OH (US)

( * ) Notice: Subject to any disclaimer, the term of this patent is extended or adjusted under 35 U.S.C. 154(b) by 167 days.

(21) Appl. No.: 16/381,551

(22) Filed: Apr. 11, 2019

(65) Prior Publication Data

US 2019/0321955 A1 Oct. 24, 2019

Related U.S. Application Data

(60) Provisional application No. 62/660,519, filed on Apr. 20, 2018.

(51) Int. Cl.
*B25C 1/04* (2006.01)
*B25C 1/06* (2006.01)

(52) U.S. Cl.
CPC ..... *B25C 1/047* (2013.01); *B25C 1/06* (2013.01)

(58) Field of Classification Search
CPC ..... B25C 1/047; B25C 1/06; B25C 1/04
USPC ..... 227/107–155
See application file for complete search history.

(56) References Cited

U.S. PATENT DOCUMENTS 227,802 A 5/1883 Stanley
472,972 A 4/1892 Appleby
1,774,967 A 9/1930 Ellis
2,575,455 A 11/1951 Lang
2,933,290 A 4/1960 Ryder
3,847,322 A 11/1974 Smith
3,878,902 A 4/1975 Matsuo
(Continued)

FOREIGN PATENT DOCUMENTS

DE 15 10 164 A1 3/1970
GB 1 559 571 A 1/1980

OTHER PUBLICATIONS

Two-page "Tool Assembly" drawing of Senco Model No. SN952XP pneumatic tool; dated Mar. 4, 2008; representative of earlier tools in public use before 2006; Admitted Prior Art.
(Continued)

*Primary Examiner* — Robert F Long
(74) *Attorney, Agent, or Firm* — Frederick H. Gribbell; Russell F. Gribbell

(57) ABSTRACT

A fastener driving tool that includes a lifter subassembly for moving the driver from a driven position to a ready position. In one embodiment, the lifter is mounted to a movable pivot arm, and if the driver is mispositioned at the beginning of a lifting phase, the lifter can displace a small distance to allow the lifter to move over the driver's protrusions, thereby allowing the lifting phase to continue without causing a jam. A retainer (or "cam follower") is positioned along a rounded cam profile surface of at least one lifter disk to prevent the lifter from displacing during later portions of the lifting phase, or during a transition phase. The lifter includes at least two rotating disks with extending pins to engage driver protrusions. One of the lifter disks can have gear teeth on its perimeter, instead of a cam profile surface.

25 Claims, 26 Drawing Sheets

(56) References Cited

U.S. PATENT DOCUMENTS 4,129,240 A * 12/1978 Geist ..... B25C 1/06 227/131
4,203,353 A 5/1980 Bernham et al.
4,215,808 A 8/1980 Sollberger et al.
4,530,455 A 7/1985 Vomberger
4,570,504 A 2/1986 Sitta
4,834,278 A * 5/1989 Lin ..... B25C 1/06 227/131
5,503,319 A 4/1996 Lai
5,557,905 A 11/1996 Cook
5,595,251 A 1/1997 Cook, Jr.
5,720,423 A 2/1998 Kondo et al.
6,023,989 A 2/2000 Imase
6,533,156 B1 3/2003 Chang
6,938,811 B2 9/2005 Ehmig et al.
6,997,367 B2 2/2006 Hu
7,040,521 B2 5/2006 Kolodziej et al.
7,225,961 B1 6/2007 Lee
7,225,962 B2 6/2007 Porth et al.
8,011,547 B2 9/2011 Leimbach et al.
8,267,297 B2 9/2012 Leimbach et al.
2003/0218042 A1 11/2003 Odoni et al.
2005/0082334 A1 4/2005 Hu
2006/0043143 A1* 3/2006 Kolodziej ..... B25C 1/003 227/130
2006/0124331 A1* 6/2006 Stirm ..... F16D 43/208 173/178
2006/0180631 A1 8/2006 Pedicini
2007/0007319 A1 1/2007 Simonelli et al.
2007/0045377 A1 3/2007 Towfighi
2008/0190986 A1 8/2008 Chang
2009/0090762 A1* 4/2009 Leimbach ..... B25C 1/041 227/130
2009/0236387 A1* 9/2009 Simonelli ..... B25C 5/1668 227/8
2011/0198381 A1* 8/2011 McCardle ..... B25C 1/06 227/8
2013/0175066 A1* 7/2013 Zhang ..... B25B 21/00 173/47
2015/0096776 A1* 4/2015 Garber ..... B25C 1/008 173/1
2015/0202755 A1 7/2015 Tanji
2015/0352702 A1 12/2015 Chien
2016/0229043 A1* 8/2016 Wyler ..... B25C 1/06
2016/0288305 A1 10/2016 McCardle et al.
2017/0190037 A1 7/2017 Sato
2018/0126527 A1* 5/2018 Pomeroy ..... B25C 1/008
2018/0126528 A1* 5/2018 Pomeroy ..... B25C 1/008
2018/0178361 A1* 6/2018 Kabbes ..... B25C 1/008
2018/0290279 A1* 10/2018 Kobori ..... B25C 1/06
2019/0168366 A1* 6/2019 Yasutomi ..... B25C 1/008
2020/0114500 A1* 4/2020 Bierdeman ..... B25C 1/06
2020/0164498 A1* 5/2020 Wechselberger ..... B25C 1/047
2020/0269149 A1* 8/2020 Chung ..... A63H 29/22

OTHER PUBLICATIONS

One-page magnified view of "Tool Assembly" drawing of Senco Model No. SN952XP pneumatic tool; Mar. 4, 2008; representative of earlier tools in public use before 2006; Admitted Prior Art.

* cited by examiner

LIFT MECHANISM FOR FRAMING NAILER

CROSS-REFERENCE TO RELATED APPLICATIONS

The present application claims priority to provisional patent application Ser. No. 62/660,519, titled "IMPROVED LIFT MECHANISM FOR FRAMING NAILER," filed on Apr. 20, 2018.

TECHNICAL FIELD

The technology disclosed herein relates generally to linear fastener driving tools and, more particularly, is directed to portable tools that drive staples, nails, or other linearly driven fasteners. At least one embodiment is disclosed as a linear fastener driving tool, in which a pressure vessel with a working cylinder is filled with compressed gas which is used to quickly force a piston through a driving phase of movement, while also driving a fastener into a workpiece. The piston is then moved back to its starting position during a return phase of movement by use of a rotary-to-linear lifter subassembly, thereby preparing the tool for another driving phase. An elongated driver member (or driver blade, or simply "driver") is attached to the piston, and has a plurality of spaced-apart protrusions along its surface that are used to contact the lifter subassembly, which lifts the driver during the return phase. These driver protrusions are also sometimes referred to herein as driver "teeth."

The lifter subassembly is pivotable, and is able to move into either an interfering position or a non-interfering position with respect to the driver protrusions. The lifter subassembly in an illustrated embodiment includes a pair of "pivot arms" that each has two ends; the first end is mounted on a pivot arm shaft, which in turn is mounted to a "lifter base," which is part of the nailer tool's "guide body" near the area where the driver is located. The pivot arm shaft acts as a pivot axis for the entire pivot arm.

The second end of each pivot arm includes a lifter bearing to which a lifter shaft is mounted and, in a first embodiment, a pair of parallel, rotatable lifter disks is mounted to this lifter shaft. A lifter gear is also mounted on the lifter shaft. The lifter gear and both lifter disks rotate together about the lifter shaft; therefore, when the lifter gear is rotated (by a mating drive gear), the lifter disks are forced to rotate, which occurs during a "lifting phase" (or "return phase") to move the driver blade back to its "ready" position.

In the illustrated embodiment, the lifter disks each have several lifter "pins" that extend from each of the lifter disks at right angles, and which are used to engage the protrusions of the driver. When so engaged (during a first mode of operation), the lifter pins of the rotatable lifter gear will force the driver to undergo a return (or "lifting") phase. In a first embodiment, the lifter pins extend all the way from the first lifter disk to the second lifter disk. In a second embodiment, the lifter pins only extend part way between the two lifter disks, and there is a gap between the two sets of lifter pins.

The lifter subassembly is powered by an electric motor that rotates a gear train, which causes the lifter gear at the second end of the pivot arm to rotate. In the first two embodiments, the lifter gear causes both lifter disks to rotate, which occurs when the tool undergoes a return phase. When the lifter subassembly begins the return phase, the lifter pins are rotated to engage the driver teeth, so that when the lifter disks rotate, the driver is forced "upward" (or "lifted") as the lifter pins contact the driver teeth, such that the driver moves linearly through a driver track in the guide body of the tool.

However, if the driver has stopped at an unexpected position in the driver track—i.e., the driver's position is "out of specification"—then the lifter pins may not be able to successfully fit into one of the spaces between the plurality of driver teeth. Therefore, the "lead" lifter pin may contact the protruding tip of one of the driver teeth, which potentially may cause a "jam" to occur between the lifter pin and the contacted driver tooth. That type of misposition could even break the driver, because the lifter is quite sturdy, and it moves with great torque, enough to sometimes break a driver in the event of a jam. (Typically, if an actual jam should occur, then the tool must be deactivated and disassembled so as to un-jam the lifter pins from the driver.)

To prevent this type of jam, the pivot arm of the lifter will provide a degree of freedom of movement, such that the entire lifter subassembly that is mounted to the lifter shaft can displace (or pivot) away from the driver to a certain extent, which then allows the "lead" lifter pin to slide over the driver tooth's surface, and therefore, prevents any jam from occurring. In essence, the lifter subassembly is able to "release" from making "hard contact" with the driver, when necessary, and this release ability allows the lifter subassembly to prevent jams in most situations.

The lifter subassembly is spring-loaded such that it is biased toward the driver, which normally keeps the lifter pins in contact with the driver during a lifting (or return) phase, and this is the desirable operating condition of the tool. Typically, the only time that the lifter subassembly will even desire to "release" from contact with the driver teeth is if the driver becomes mis-positioned in a manner that prevents the "lead" lifter pin from properly engaging one of those driver teeth.

The lifter assembly also includes a retainer that somewhat acts as a cam follower. The lifter disks each exhibit an outer shape that acts as a cam; part of the perimeter of the lifter disk is curved (or "arcuate") like a circle, and part of the perimeter of the lifter disk has the shape of a straight line, which cuts across a portion of the arc of that circle. During the initial stage of a lifting (return) phase, the straight line (or "flat") portion of the lifter disk is positioned proximal to the retainer, such that the retainer does not make contact with the perimeter of the lifter disk. This allows the lifter subassembly to displace away from the driver to prevent a jam, during this initial stage of the lifting phase. During a later portion of the lifting phase, the rounded portion of the lifter disk's perimeter becomes rotated to a proximal position with respect to the retainer. When that occurs, the retainer makes contact with the lifter disk, and thus, constrains movement of the lifter disk by preventing any substantial displacement by the lifter disk away from the driver. This causes the lifter pins to always remain in an "interfering position" with respect to the driver teeth during this later portion of the lifting phase, even if there are force vectors that may attempt to "push" the lifter disk away from the driver.

At the end of a lifting (return) phase, the "final" lifter pin will be in contact with one of the driver pins, thereby holding the driver at its "ready" position. In this state, the driver can quickly "fire" in a drive (or "driving") phase, and push a fastener out the exit end of the driver track, and into a workpiece. Before the driving phase begins, a "transition phase" of movement occurs by a further rotation of the lifter disk. At first, the driver is forced "upward" a small distance during the transition phase, to the point where that "final" lifter pin moves away from contact with the driver tooth, and the driver suddenly becomes free. The piston in the working cylinder and pressure vessel (which contains pressurized gas) will immediately force the driver to quickly undergo a driving phase, and the lifter pins will remain out of the way during that driving phase, so as to not interfere with the driver teeth. (In other words, during a driving phase, the lifter pins remain in a "non-interfering position" with respect to the driver teeth. Similarly, during a lifting phase, the lifter pins intentionally engage with the driver teeth, and thus the lifter pins are moved into an "interfering position" with respect to the driver teeth in order to accomplish the lifting movement of the driver.)

In the first and second embodiments, the retainer comprises a shaft that is held in position by a pair of parallel brackets, which extend from the lifter base. The terminology "cam follower" sometimes used herein is not quite descriptive of this mechanical member, because it acts more as a "retainer" than it does as a "follower." In other words, this so-called cam follower does not "follow" along the surface of the cam profile of the lifter disks; instead, this mechanical member is held in place by the brackets, and only contacts the lifter disks when the round, arcuate portion of the lifter disks face that retainer. And its purpose is to "retain" the lifter subassembly in place, during the portions of rotation where the tool's designer does not wish to allow the lifter to displace away from the driver; in other words, as a retainer, it is designed to eliminate that degree of freedom of movement of the lifter subassembly during those portions of the lifter's rotation.

In a third embodiment, the lifter subassembly has two main rotatable elements, but only one of those elements is a disk that exhibits a cam profile. The other rotatable element is the lifter gear, which mates with the driver gear to rotate the lifter shaft. A number of lifter pins extend between the lifter disk and the lifter gear. The retainer element is also of a different design in this third embodiment. Instead of being mounted between two brackets, it is mounted on only one bracket; also, it has a small wheel on its shaft, to extend the effective diameter of its shaft. In this third embodiment, the retainer functions in a similar fashion to that which was disclosed in the first and second embodiments.

In a fourth embodiment, the lifter subassembly includes a single rotatable disk that has stub-end lifter pins extending from both faces of that disk. The disk is positioned at the centerline of the driver, between the pairs of driver teeth. The lifter pins will engage both teeth of a given pair of such driver teeth in a manner that substantially balances the mechanical loading forces on the driver during a lifting phase. The lifter subassembly also includes a lifter gear that provides the mechanical rotational force to cause the lifter disk to rotate; in this embodiment, the lifter gear does not have any lifter pin extending from its face. A retainer is again used to make contact with the perimeter of the lifter disk, as needed.

In a fifth embodiment, the lifter subassembly has two rotatable elements, but only one of those elements is a disk that exhibits a cam profile. The other rotatable element is a lifter pulley that is driven by a drive belt; that drive belt is propelled by a drive pulley. A number of lifter pins extend between the lifter disk and the lifter pulley. A retainer is again used to make contact with the perimeter of the lifter disk, as needed.

In a sixth embodiment, the lifter subassembly has two rotatable elements, but only one of those elements is a disk that exhibits a cam profile. The other rotatable element is a lifter sprocket that is driven by a drive chain; that drive chain is propelled by a drive sprocket. A number of lifter pins extend between the lifter disk and the lifter sprocket. A retainer is again used to make contact with the perimeter of the lifter disk, as needed.

As an optional feature, the lifter pins have cylindrical rollers that can rotate about the arcuate surface of the solid lifter pins. These rollers make the overall structure of the lifter pins somewhat more "slippery," with respect to making contact with the driver. This can be important in situations where the driver is incorrectly positioned at the end of a driving phase, because if the driver protrusions end up in a "bad" position, the lifter pins could possibly jam against the driver. However, in this embodiment the rollers are free to rotate about the outer surface of the otherwise solid lifter pins, and in a situation where the driver is incorrectly positioned, the rollers will more likely allow the lifter subassembly to slip along the surface of the driver teeth without jamming That slipping action between the "initial" driver protrusion and the "initial" lifter pin may not move the driver at all, so then (as the lifter continues to rotate) that lifter pin will be forced to "drop" into the gap between that initial driver protrusion and the "next" driver protrusion. At that point, the continued rotation of the lifter will cause that lifter pin to begin lifting the driver, due to physical contact at that engaged "next" driver protrusion. In this manner, the lifter will successfully force the driver upward for a return phase, while avoiding a jam condition from occurring.

STATEMENT REGARDING FEDERALLY SPONSORED RESEARCH OR DEVELOPMENT

None.

BACKGROUND

An early air spring fastener driving tool is disclosed in U.S. Pat. No. 4,215,808, to Sollberger. The Sollberger patent used a rack and pinion-type gear to "jack" the piston back to its driving position. A separate motor was to be attached to a belt that was worn by the user; a separate flexible mechanical cable was used to take the motor's mechanical output to the driving tool pinion gear, through a drive train.

Another air spring fastener driving tool is disclosed in U.S. Pat. No. 5,720,423, to Kondo. This Kondo patent used a separate air replenishing supply tank with an air replenishing piston to refresh the pressurized air needed to drive a piston that in turn drove a fastener into an object.

Another air spring fastener driving tool is disclosed in published patent application no. US2006/0180631, by Pedicini, which uses a rack and pinion to move the piston back to its driving position. The rack and the pinion gear are decoupled during the drive stroke, and a sensor is used to detect this decoupling. The Pedicini tool uses a release valve to replenish the air that is lost between nail drives.

Senco sells a product line of automatic power tools referred to as nailers, including tools that combine the power and the utility of a pneumatic tool with the convenience of a cordless tool. One primary feature of such tools is that they use pressurized air to drive a piston that drives the nail. In some Senco tools, that pressurized air is re-used, over and over, so there is no need for any compressed air hose, or for a combustion chamber that would require fuel.

Although Senco "air tools" are quite reliable and typically can endure thousands of driving cycles without any significant maintenance, they do have wear characteristics for certain components. For example, the piston stop (or piston "bumper") at the bottom of the drive cylinder can become compressed after thousands of driving cycles, for example.

The more cycles that a tool is used without any significant maintenance, the more compressed the bumper can become, and this compression exhibits a certain mechanical hysteresis which eventually causes the piston to halt at a lower position than it did when the tool was new. Consequently, the driver blade (or "driver") will also stop at a lower position along its longitudinal axis than when the tool was new, and after a time, this can cause variations in operation of the lifter subassembly that raises the driver and piston back to the starting (or "ready") position.

SUMMARY

Accordingly, it is an advantage to provide a fastener driving tool that uses a lifter that is capable of moving into either an interfering position or a non-interfering position with respect to protrusions on the driver.

It is another advantage to provide a fastener driving tool that includes a driver that includes protrusions that are engaged by rotating lifter pins of a lifter subassembly, in which the overall lifter subassembly includes a pivot arm that holds the lifter subassembly in an engagement position at times when the driver is to be lifted, but also allows the lifter subassembly to be pivoted away from the driver, at times when a driver tooth is contacted by the lifter at an area that is out of specification, and thereby prevents a possible jam.

It is a further advantage to provide a fastener driving tool having a lifter subassembly that can displace away from a driver portion of a fastener driving tool, so that if a portion of the lifter subassembly contacts a protrusion on the driver that is in a physical position that is out of specification (which might cause a jam if the lifter subassembly could not otherwise displace away from the driver), then, when the lifter continues to rotate, the lifter's contact surface can be displaced away from the driver's protrusion and slide over that protrusion to a position where it does not interfere with that driver protrusion. After that occurs, the lifter subassembly will displace back toward the driver to engage a different driver protrusion at a position that is acceptable for continuing the lifting phase.

It is still a further advantage to provide a fastener driving tool having a rotatable lifter subassembly in which there is at least one lifter disk that has a cam profile that allows the lifter disk to displace away from a driver portion of the driver fastening tool during an initial portion of the lifting phase of that driver, but also includes a cam follower that contacts the cam profile surface of the lifter disk at times during the transition phase where it is improper to allow the lifter subassembly to displace away from the driver. That cam follower acts as a retainer to prevent that type of inappropriate displacement of the lifter subassembly away from the driver.

It is a yet further advantage to provide a fastener driving tool having a lifter subassembly with a rotatable lifter subassembly including lifter pins that have cylindrical rollers that can rotate about the arcuate surface of the lifter pins, thereby making the overall structure of the lifter pins somewhat more slippery with respect to making contact with the driver protrusions, which can possibly prevent a jam from occurring.

It is yet another advantage to provide a fastener driving tool that includes a driver having protrusions that are engageable by rotating lifter pins of a lifter subassembly, in which the overall lifter subassembly includes a pivot arm that, when located in a first position, holds the lifter subassembly in an engagement position at times when the driver is to be lifted during normal operating conditions, but also has a degree of freedom such that the pivot arm is movable toward a second position such that, during abnormal operating conditions, the pivot arm is able to automatically release from its first position and allow the lifter subassembly to displace toward the second position, thereby preventing the lifter subassembly and the driver from jamming.

It is still another advantage, in more general terms, to provide a fastener driving tool that includes an elongated driver having a first contacting surface that is engageable by a second contacting surface of a lifter subassembly, in which the overall lifter subassembly includes a movable arm that, when located in a first position, holds the lifter subassembly in an engagement position at times when the driver is to be lifted during normal operating conditions, but also has a degree of freedom such that the movable arm is movable toward a second position so that, during abnormal operating conditions, the movable arm is able to automatically release from its first position and allow the lifter subassembly to displace toward the second position, thereby preventing the lifter subassembly and the driver from jamming.

It is yet a further advantage to provide a fastener driving tool that includes a rotatable lifter disk that has multiple stub-end lifter pins that extend from both sides of the disk, in which that lifter disk is positioned along the centerline of a driver that has multiple teeth that protrude from a surface of the driver, in which the multiple driver teeth are positioned in pairs at an equal distance from that centerline, so that when the lifter pins engage the driver teeth, the mechanical loading forces on the driver are substantially balanced during a lifting phase from a driven position to a ready position.

It is still a further advantage to provide a fastener driving tool that includes at least one rotatable lifter disk with multiple lifter pins that extend from at least one side of the at least one rotatable lifter disk, in which the lifter disk(s) is caused to rotate by one of: (a) a gear train; (b) a set of pulleys and a drive belt; or (c) a set of sprockets and a drive chain.

Additional advantages and other novel features will be set forth in part in the description that follows and in part will become apparent to those skilled in the art upon examination of the following or may be learned with the practice of the technology disclosed herein.

To achieve the foregoing and other advantages, and in accordance with one aspect, a driving apparatus for use in a fastener driving tool is provided, the driving apparatus comprising: (a) a guide body that receives a fastener that is to be driven from an exit end of the guide body; (b) an elongated driver having a first end that is sized and shaped to push a fastener from the exit end, the driver having a second, opposite end, the driver having a direction of movement along a driver track of the guide body, the driver exhibiting a first contacting surface located between the first end and the second end, the driver having a ready position that is distal from the exit end, and the driver having a driven position that is proximal to the exit end; (c) a movable arm that exhibits a proximal end and a distal end, the proximal end being in communication with the guide body and the distal end having a rotator mounted thereto, the rotator including a second contacting surface, the movable arm being movable between a first position and a second position, the movable arm being biased toward the first position, the movable arm having a mechanical freedom of movement toward the second position, and if the movable arm is in the first position, then the second contacting surface of the rotator is in an engagement position with respect to the first contacting surface of the driver; and (d) a retainer that physically contacts a third contacting surface of the rotator during at least a portion of a transition phase of a movement cycle, but that does not physically contact the third contacting surface of the rotator during a predetermined portion of a lifting phase of the movement cycle; (e) wherein: (i) during the predetermined portion of the lifting phase, the second contacting surface of the rotator attempts to physically contact the first contacting surface of the driver and thus cause the driver to move toward the ready position; (ii) however, during the predetermined portion of the lifting phase, if the driver and the rotator are misaligned, such that the first contacting surface cannot be properly contacted by the second contacting surface, then the mechanical freedom of movement of the movable arm allows the rotator to displace from the first position toward the second position, which allows the second contacting surface to move past the misaligned first contacting surface without jamming; and (iii) during a first portion of the transition phase, if mechanical loading forces upon the rotator tend to separate the second contacting surface of the rotator from the first contacting surface of the driver, then physical contact between the retainer and the third contacting surface of the rotator prevents the rotator from displacing from the first position toward the second position.

In accordance with another aspect, a driving apparatus for use in a fastener driving tool is provided, the driving apparatus comprising: (a) a guide body that receives a fastener that is to be driven from an exit end; (b) an elongated driver having a first end that is sized and shaped to push a fastener from the exit end, the driver having a second, opposite end, the driver having a direction of movement along a driver track of the guide body, the driver including a plurality of protrusions along at least one surface of the driver between the first end and the second end, wherein the plurality of protrusions are substantially equidistant from a centerline of the driver along its direction of movement, the driver having a ready position that is distal from the exit end, the driver having a driven position that is proximal to the exit end; and (c) a rotator which includes at least one rotatable disk, the at least one rotatable disk having a plurality of lifter extensions extending from at least one surface of the at least one rotatable disk, the plurality of lifter extensions being movable to an engagement position with respect to the plurality of protrusions of the driver; (d) wherein, for moving the driver from the driven position to the ready position: (i) the at least one rotatable disk rotates in a first direction, and (ii) a rotational movement of the plurality of lifter extensions engage with the plurality of spaced-apart protrusions in a manner that substantially balances mechanical loading forces on the driver during a lifting phase from the driven position to the ready position.

In accordance with yet another aspect, a driving apparatus for use in a fastener driving tool is provided, the driving apparatus comprising: (a) a guide body that receives a fastener that is to be driven from an exit end; (b) an elongated driver having a first end that is sized and shaped to push a fastener from the exit end, the driver having a second, opposite end, the driver being movable along a driver track in the guide body, the driver including a plurality of protrusions along at least one surface, the driver having a ready position that is distal from the exit end, and the driver having a driven position that is proximal to the exit end; (c) a movable arm that exhibits a proximal end and a distal end, the proximal end being in communication with the guide body, the distal end having at least one rotatable disk mounted thereto, the at least one rotatable disk including a plurality of extensions that extend from at least one surface of the at least one rotatable disk, the at least one rotatable disk having an outer perimeter having a predetermined shape, in which a first portion of the outer perimeter is arcuate, and a second portion is indented, the movable arm being movable between a first position and a second position, the movable arm being biased toward the first position, the movable arm having a mechanical freedom of movement toward the second position, and if the movable arm is in the first position, then at least one of the plurality of extensions is configured to make physical contact with at least one of the plurality of protrusions of the driver; and (d) a retainer that physically contacts a the arcuate first portion of the outer perimeter of the at least one rotatable disk during at least a portion of a transition phase of a movement cycle, but that does not physically contact the indented second portion of the outer perimeter of the at least one rotatable disk during a predetermined portion of a lifting phase of the movement cycle; (e) wherein: (i) during the predetermined portion of the lifting phase, the plurality of extensions of the at least one rotatable disk attempts to physically contact the plurality of protrusions of the driver and thus cause the driver to move toward the ready position; (ii) however, during the predetermined portion of the lifting phase, if the driver and the at least one rotatable disk are misaligned, such that the plurality of protrusions cannot be properly contacted by the plurality of extensions, then the mechanical freedom of movement of the movable arm allows the at least one rotatable disk to displace from the first position toward the second position, which allows the plurality of extensions to move past the misaligned plurality of protrusions without jamming; and (iii) during a first portion of the transition phase, if mechanical loading forces upon the at least one rotatable disk tend to separate the plurality of extensions of the at least one rotatable disk from the plurality of protrusions of the driver, then physical contact between the retainer and the outer perimeter of the at least one rotatable disk of the at least one rotatable disk prevents the at least one rotatable disk from displacing from the first position toward the second position.

Still other advantages will become apparent to those skilled in this art from the following description and drawings wherein there is described and shown a preferred embodiment in one of the best modes contemplated for carrying out the technology. As will be realized, the technology disclosed herein is capable of other different embodiments, and its several details are capable of modification in various, obvious aspects all without departing from its principles. Accordingly, the drawings and descriptions will be regarded as illustrative in nature and not as restrictive.

BRIEF DESCRIPTION OF THE DRAWINGS

The accompanying drawings incorporated in and forming a part of the specification illustrate several aspects of the technology disclosed herein, and together with the description and claims serve to explain the principles of the technology. In the drawings:

FIG. 9 shows an initial lifter position, in which a lifter pin is contacting a driver tooth that is positioned such that the lifter pin contacts the top of the driver tooth, which is out of specification, at the beginning of a lifting phase.

FIG. 10 is the second side view in this sequence, and shows the lifter pin beginning to slide (or roll) over the top portion of a driver tooth, as the lifter subassembly displaces away from the driver.

FIG. 11 is the third side view in this sequence, showing the lifter pin sliding down the back side of the driver tooth, thereby clearing that driver tooth.

FIG. 12 is the fourth side view in this sequence, showing that lifter pin engaging the bottom of the "next" driver tooth, thereby beginning a lifting phase of the driver.

FIG. 13 is the fifth side view of this sequence, showing the lifter pin continuing the lifting phase of the driver, and also showing a cam follower engaging the outer surface of the lifter disk.

FIG. 14 is the sixth side view in this sequence, showing the lifter pins continuing the lifting phase of the driver, and showing the cam follower continuing to engage the outer surface of the lifter disk.

DETAILED DESCRIPTION

Figure 1:
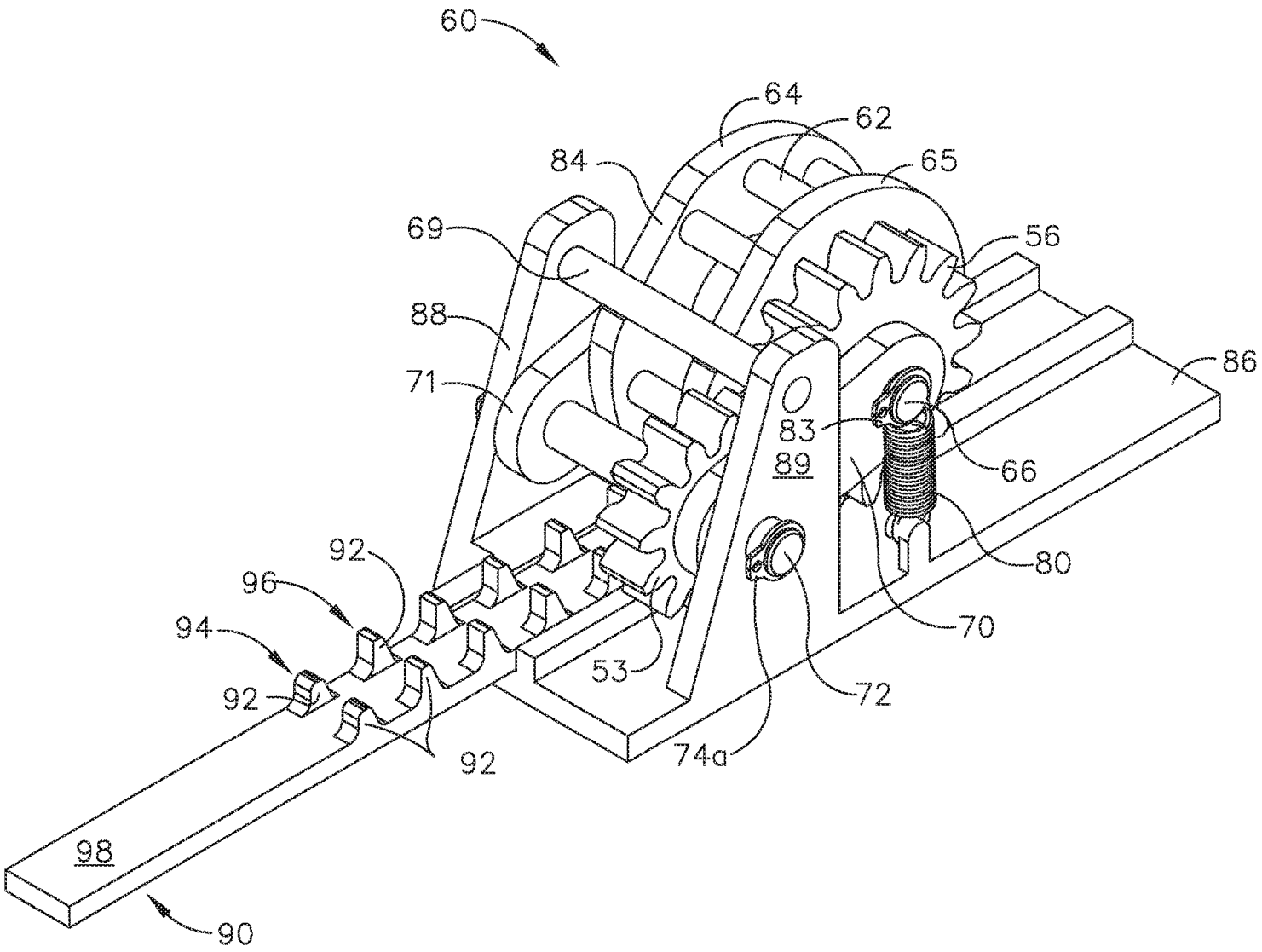
FIG. 1 is a perspective view from above and to one side of a first embodiment lifter subassembly for a fastener driving tool, as constructed according to the principles of the technology disclosed herein.

Reference will now be made in detail to the present preferred embodiment, an example of which is illustrated in the accompanying drawings, wherein like numerals indicate the same elements throughout the views.

It is to be understood that the technology disclosed herein is not limited in its application to the details of construction and the arrangement of components set forth in the following description or illustrated in the drawings. The technology disclosed herein is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

The terms "first" and "second" preceding an element name, e.g., first inlet, second inlet, etc., are used for identification purposes to distinguish between similar or related elements, results or concepts, and are not intended to necessarily imply order, nor are the terms "first" and "second" intended to preclude the inclusion of additional similar or related elements, results or concepts, unless otherwise indicated.

Referring now to FIG. 1, a lifter subassembly, generally referred to by the reference numeral 60, is illustrated along with a driver member (or simply, "driver") 90. The lifter subassembly 60 includes a pair of parallel lifter disks 64 and 65, which have a plurality of lifter "pins" 62 that extend between the two lifter disks 64 and 65. The lifter disks are mounted on a lifter shaft 66, and both lifter disks rotate together. There also is a lifter gear 56 that rotates with the lifter disks 64, 65; the lifter disks and lifter gear are all connected by a hub. It will be understood that portions of the "lifter subassembly" can also be referred herein to as a "lifter rotator," and have a similar meaning.

The lifter subassembly is mounted to a lifter base 86, which has a pair of parallel extensions at 88 and 89, which act as brackets for a cam follower 69, which acts as a retainer (explained below in greater detail). The brackets 88 and 89 also have openings for a pivot arm shaft 72, that extends between the two brackets. A drive gear 53 is mounted to the pivot arm shaft 72, and also a pair of pivot arms 70 and 71 are mounted to that pivot arm shaft. Two snap rings 73 and 74*a* hold the pivot arm shaft 72 in place; snap rings 73 and 74*a* are illustrated on FIG. 3.

Figure 2:
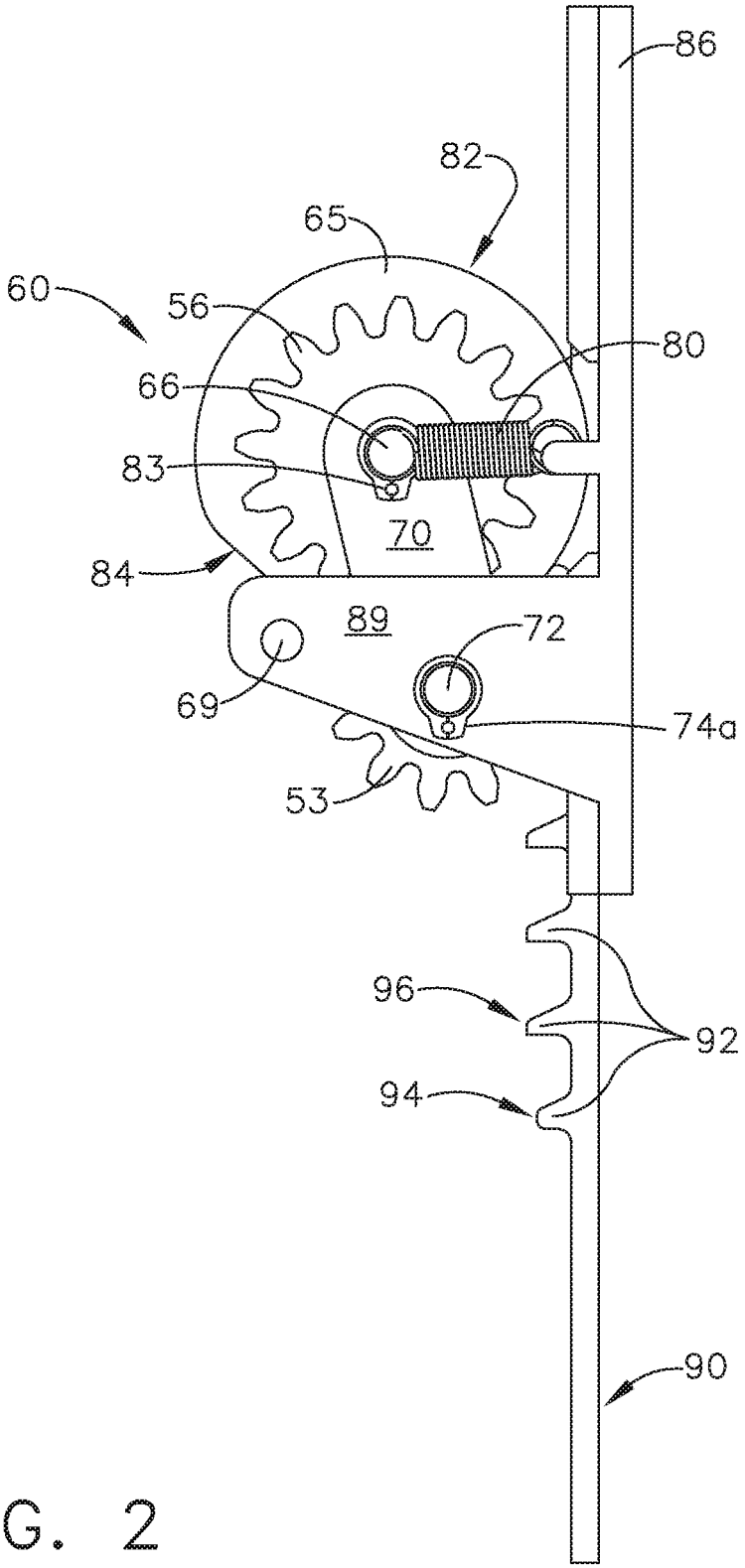
FIG. 2 is a side-elevational view of the lifter subassembly of FIG. 1.

The two pivot arms 70 and 71 extend in parallel from the pivot arm shaft 72 to the lifter shaft 66. The two pivot arms are pivotable at the centerline of the pivot arm shaft 72, which allows the movable portion lifter subassembly 60 to rotationally displace about that pivot point. An extension spring 80 is mounted between the lifter base 86 and the lifter shaft 66, so that the movable portion lifter subassembly 60 is biased in a way that tends to hold the lifter subassembly against the driver 90. In FIG. 2, the lifter subassembly 60 and the pivot arm 70 are illustrated in an "engagement position," which is also sometimes referred to herein as a "first position" of the pivot arm, and while in this first position, the lifter subassembly 60 can engage with the driver 90, as explained below. It will be understood that the phrase "movable arm" can describe the movements of these pivot arms 70 and 71.

The driver 90 extends along a driver track 93 in a guide body of the fastener driving tool. This driver 90 can move along a (linear) direction of movement through the driver track 93 between a "first end travel location" and a "second end travel location," which are essentially the end limits of the driver track—actually, the driver can slightly extend out the bottom of the tool (at an "exit end" of the guide body) to firmly place a fastener into a workpiece, and this exit end is indicated at a reference numeral 244 on FIG. 18, for a third embodiment that is discussed below.

The driver 90 includes several driver teeth 92, which extend from a generally planar surface 98 of the driver. As can be seen in FIG. 1, there are multiple driver teeth 92, and some of them may have a different profile; for example, the "first" driver tooth has a profile as indicated at 94 that extends a lesser distance than the profile of the "second" driver tooth at 96. These driver teeth are sometimes referred herein as a "first contacting surface," and will be discussed in greater detail below.

Referring now to FIG. 2, the same lifter subassembly 60 is illustrated in a side view, showing the same components as were discussed above, in reference to FIG. 1. The two different profiles of some of the driver teeth 92 are better illustrated on FIG. 2, and the shapes of the extensions of the "first" and "second" teeth are illustrated at 94 and 96, respectively. In FIG. 2 the lifter subassembly 60 is positioned in its "engaged" position, which means that the lifter pins 62 will engage the driver teeth 92, so that the lifter disks 64 and 65, when rotated, will "lift" the driver 90 upward (in this view) to push the piston "up" (not shown) the cylinder of the driver fastener tool. These lifter pins 62 act as a "second contacting surface" that can engage the "first contacting surface" (e.g., the driver teeth). Also seen on FIG. 2, is a portion of the "cam profile" of the two lifter disks 64, and 65. As can be seen on FIG. 2, the lifter disk 65 has a "round portion" at 82, and a "flat portion" (or "indented portion") at 84. This cam profile will be described in greater detail below.

Figure 3:
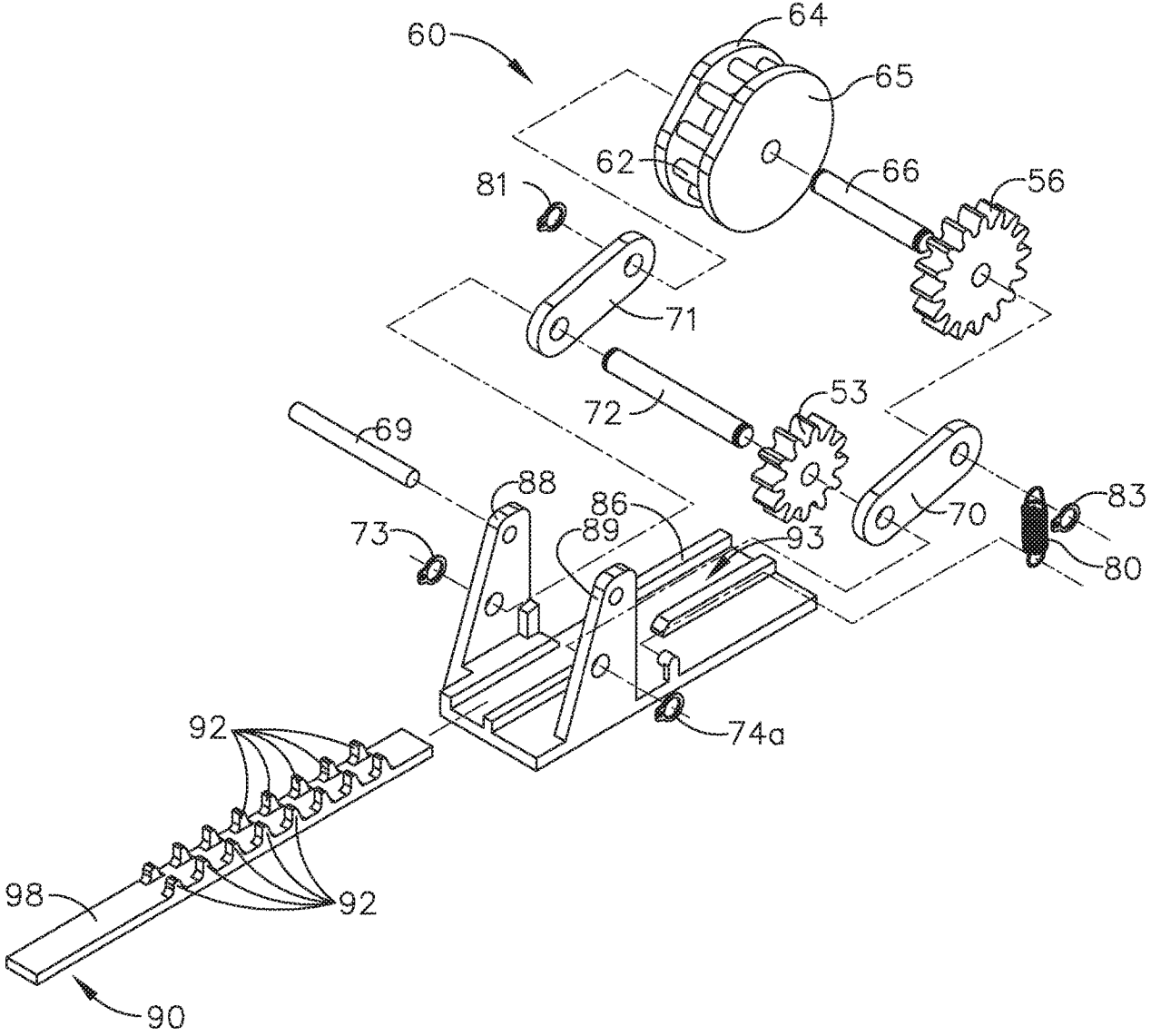
FIG. 3 is an exploded view of the lifter subassembly of FIG. 1.

Referring now to FIG. 3, an exploded view is provided showing the individual parts that make up the structure illustrated on FIGS. 1 and 2. The lifter subassembly 60 is illustrated having the two lifter disks 64 and 65, which are mated together by a hub, and there are a plurality of lifter pins 62 shown that extend between the two disks. The lifter shaft 66 also extends through the open hub of the lifter gear 56. The two snap rings 81 and 83 are applied to the ends of the lifter shaft 66. The extension spring 80 also goes around the lifter shaft 66.

FIG. 3 also illustrates the lifter base 86 with its two extending brackets 88 and 89. One of the pivot arms 71 is illustrated having an opening that allows the pivot arm shaft 72 to extend therethrough, which also extends through two openings in the two brackets 88 and 89. The pivot arm shaft 72 also extends through the drive gear 53, and through an opening in the other pivot arm 70. Snap rings 73 and 74*a* hold the pivot arm shaft in place. Pivot arm shaft 72 is keyed to drive gear 53, and causes the drive gear to rotate during a return ("lifting") phase.

The cam follower 69 is placed through two other openings in the brackets 88 and 89. The driver 90 runs along a driver track 93 that is part of the lifter base 86, and continues through the guide body 240 (see FIG. 18).

It should be noted that the views of FIGS. 1 and 2 show the lifter subassembly 60 and the driver 90 in the "down" (or "driven") position for the driver. This is the position that is obtained by the driver 90 after a fastener has been driven from the tool, after which the driver 90 needs to be "lifted" back to its "start" (or "ready") position, so it can be ready to drive another fastener. This "lifting" phase occurs by rotating the lifter disks 64 and 65, which cause the lifter pins 62 to engage the driver teeth 92 in a manner that forces the driver 90 to be pushed upward (in the orientation of FIG. 2) toward the ready position. The details of the engagement of the lifter pins 62 and the driver teeth 92 is better described below, in reference to FIGS. 9-14.

Figure 4:
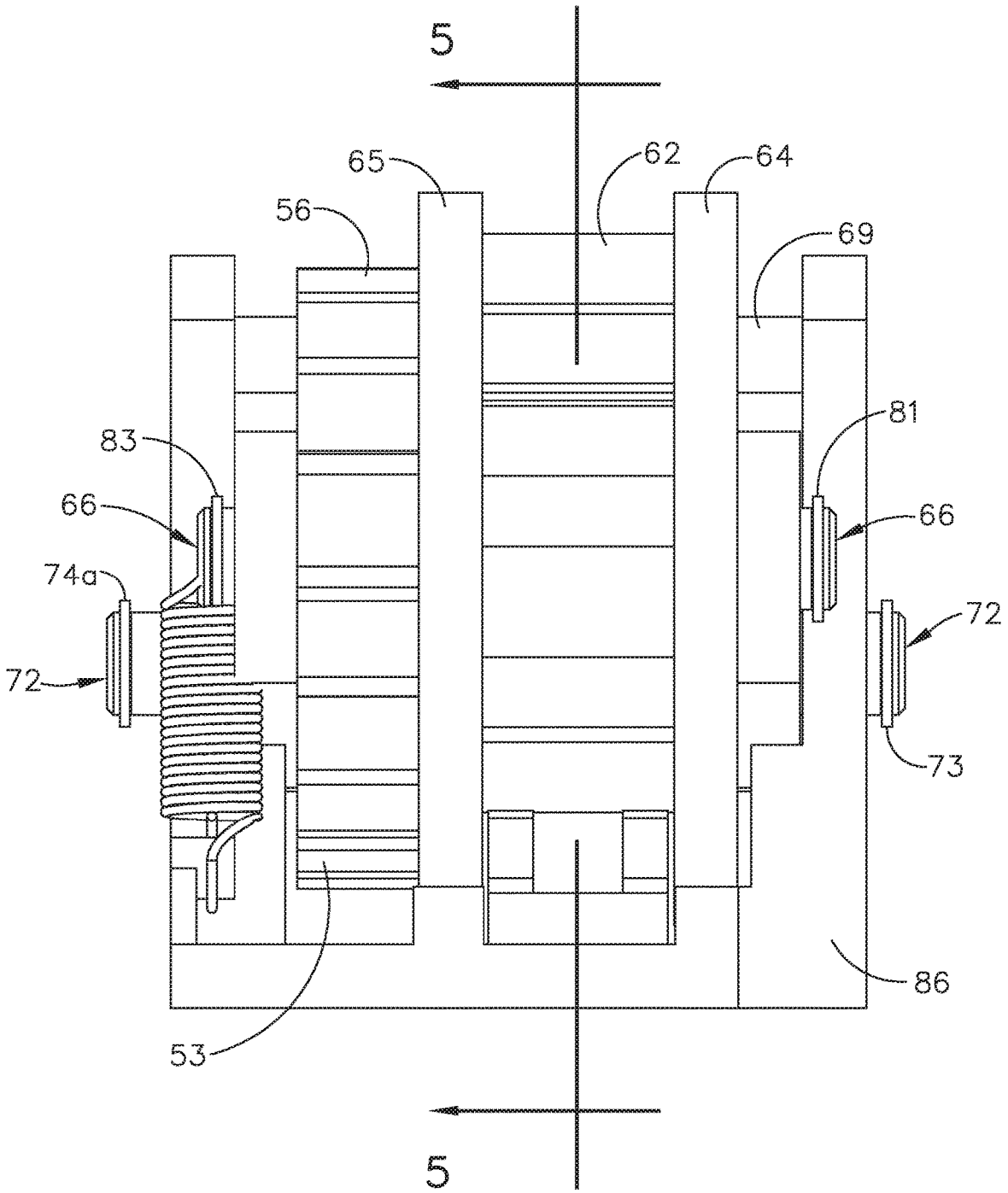
FIG. 4 is an end view from above, as a plan view of the lifter subassembly of FIG. 1.

Referring now to FIG. 4, the lifter subassembly and portions of the lifter base are illustrated in an end view, which essentially is a top elevational view when the tool is held in a position where the driver track is vertical, and a fastener is going to be driven in the downward direction (i.e., into the page of FIG. 4). The orientation of the lifter disks 65 and 64 is easily seen with respect to the lifter gear 56, and those components are all mounted on the lifter shaft 66. The drive gear 53 cannot be seen in FIG. 4, but its pivot arm shaft 72 is visible. The lifter pins 62 are visible, and so is the cam follower 69.

Figure 5:
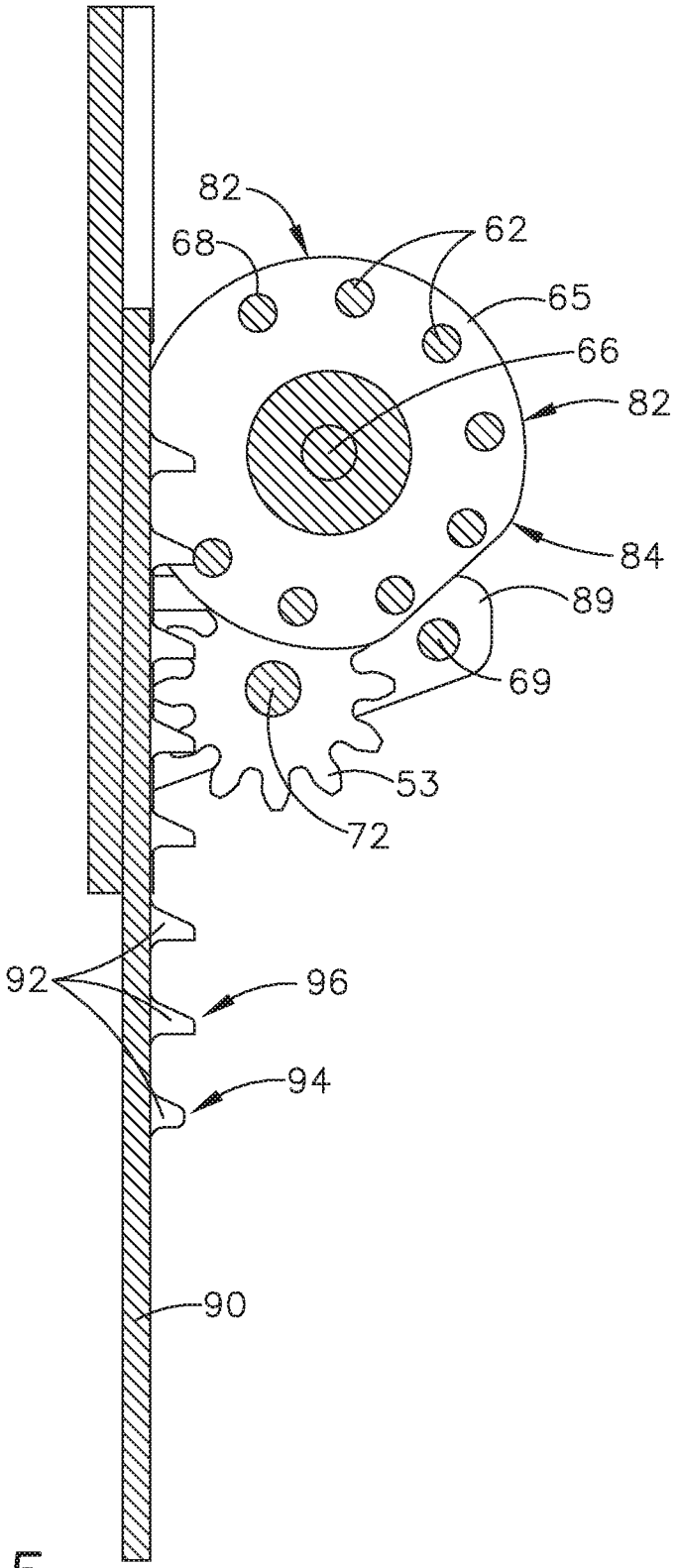
FIG. 5 is a cross-section view taken along the line 5-5 in FIG. 4, showing the lifter subassembly from its side.

FIG. 5 is a cross-section view taken along the line 5-5 on FIG. 4. On FIG. 5, the "cam profile" shape of the lifter disk 65 is easily seen, in which the round portion of the cam profile is indicated at 82, and the flat portion of the cam profile is indicated at 84. The shapes of the driver teeth 92 are also clearly visible on FIG. 5, including the profile of the "first tooth" at 94 and the profile of the "second tooth" at 96. It should be noted that these two different tooth shapes are optional; the "first tooth" 94 could have the exact same profile shape as the rest of the driver teeth, such as seen at 96. One reason for varying the shape of the "first pin" at 94 is to slightly change the phase of the lift. The lower profile at 94 of this "first pin" does not require the same amount of lift displacement before releasing as it would if it had the same profile of the other driver teeth (as at 96). However, this is an optional feature, which can be used, or not.

Another optional feature is illustrated on FIG. 5. The lifter pins 62 can be provided with small rollers, and one of the pins is illustrated with such a roller at 68. If these rollers are used, then at least some of the individual lifter pins 62 would be provided with such a roller, as per the one at 68. The rollers allow the lifter pins to essentially be a little more "slippery," so that if the driver stops at a position where the driver teeth 92 are somewhat out of position to an extent that causes difficulties for the lifter pins 62 to properly engage in the space between two of the driver teeth, then the roller will more easily allow the lifter pin 62 to "slip" over the out-of-position driver tooth. In this description, all references to a "lifter pin 62" will assume that a roller 68 is provided on at least some of these lifter pins, without referring to the rollers themselves as individual parts.

Figure 6:
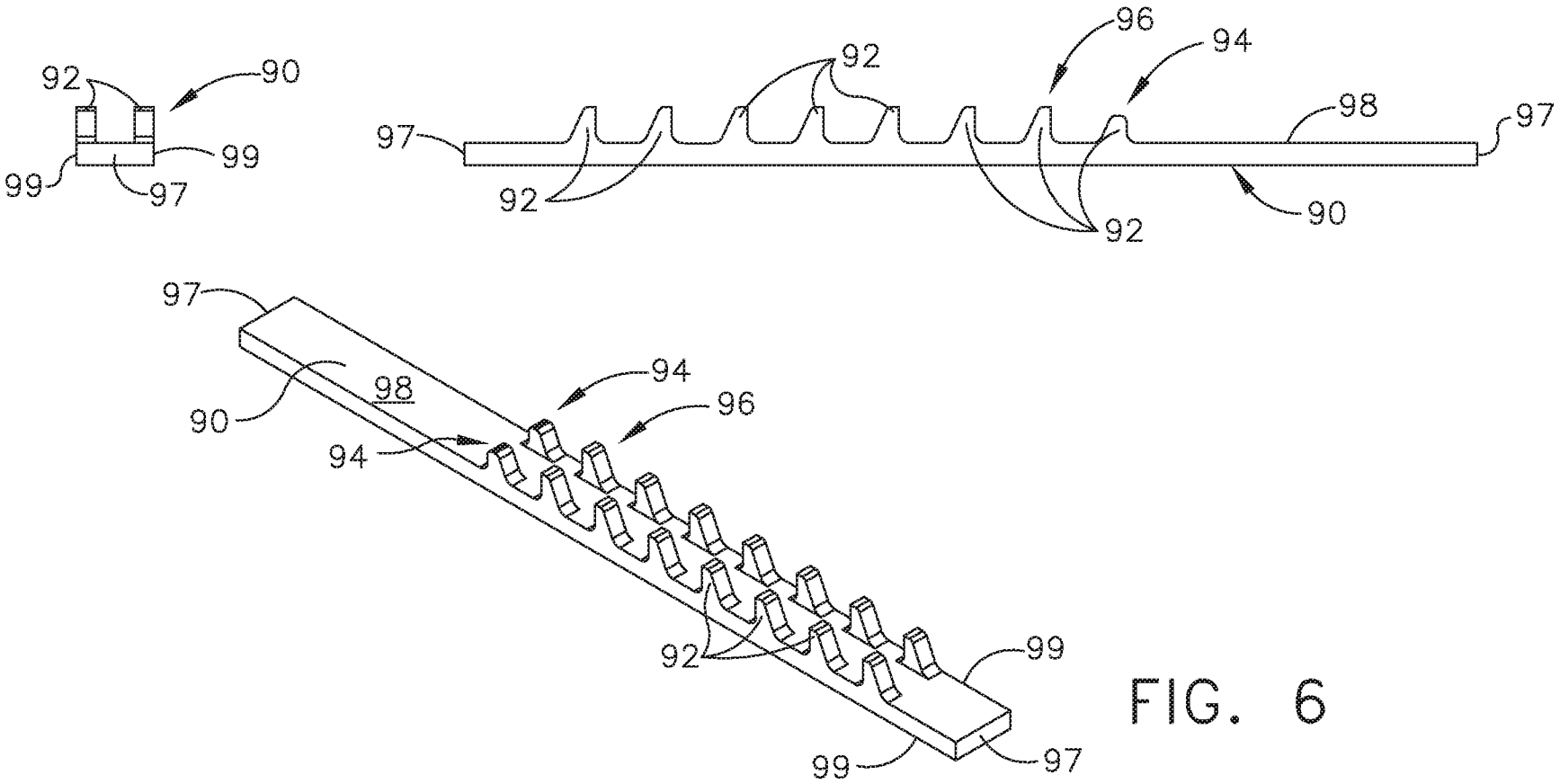
FIG. 6 is a set of views of the driver used in the lifter subassembly of FIG. 1.

Referring now to FIG. 6, the driver 90 is illustrated in three different orientations. On FIG. 6, there are eight pairs of individual driver teeth 92, which include the "first tooth" with a different profile at 94. All of the other driver teeth have the "second tooth" profile, as per the one indicated at 96. The driver "blade" exhibits two longitudinal side edges at 99, two end edges at 97, and a generally planar surface 98 from which the driver teeth 92 protrude. The driver teeth are also sometimes referred to herein as "spaced-apart protrusions."

As noted above, the driver 90 has eight pairs of driver teeth 92 which extend from the driver's planar surface at 98. The lifter pins 62 are configured to physically engage these eight pairs of driver teeth 92 in a manner so as to equally share the mechanical loading forces on each pair of driver teeth as they become engaged with one of the lifter pins 62. With the lifter pins 62 positioned as illustrated in the drawings, and with the driver teeth 92 being positioned substantially equidistant from the longitudinal centerline of the driver 90, this arrangement of lifter pins 62 will tend to substantially balance the mechanical loading forces on the driver 90 during a lifting phase, because the loading forces are essentially symmetric—in other words, the mechanical structure will then successfully operate in a predictable and desired fashion. Note, however, in this design, the forces on the driver from left to right (in FIG. 23, for example) are the substantially balanced forces; the forces in the back to front direction of the driver are not necessarily balanced.

Figure 7:
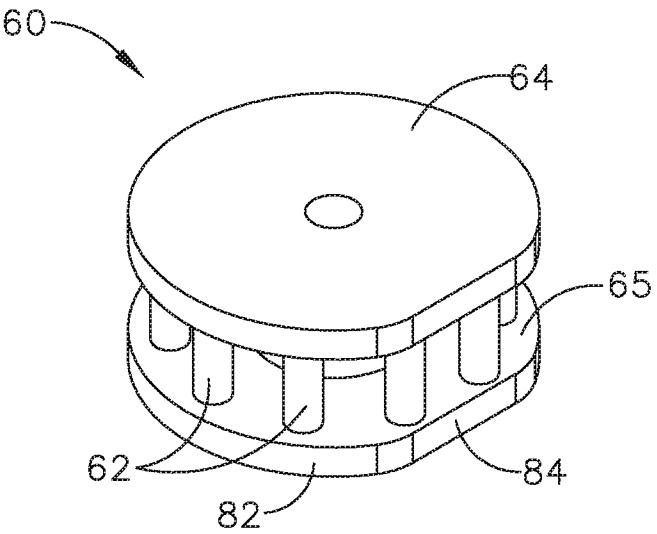
FIG. 7 is a set of views of the lifter subassembly itself that is used in the arrangement of FIG. 1.
Figure 7:
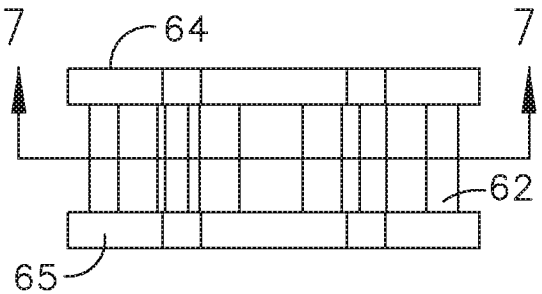
Figure 7:
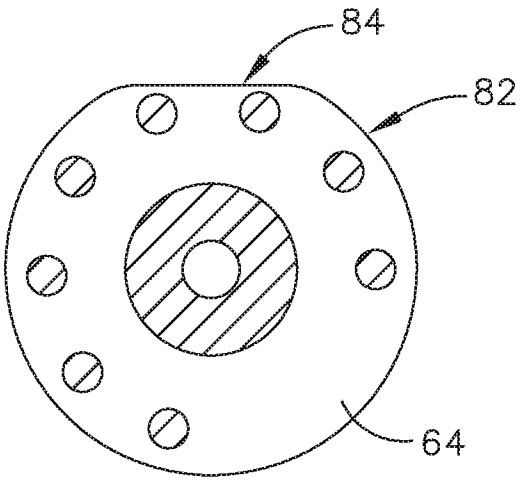

Referring now to FIG. 7, the lifter rotator 60 is illustrated in three different orientations. The "cam profile" of the lifter disk 64 is clearly illustrated, in which there is a round (or "arcuate") portion at 82 and a flat (or "indented") portion at 84. The side view in FIG. 7 is a cross-section of the top view, taken along the section line 7-7.

Figure 8:
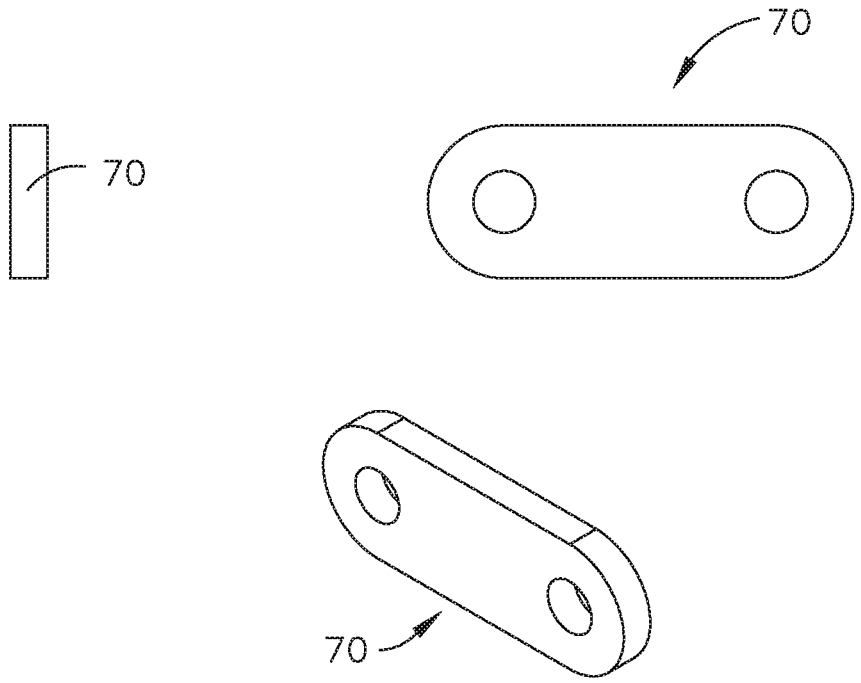
FIG. 8 is a set of views of the pivot arm used in the lifter subassembly of FIG. 1.

FIG. 8 shows the pivot arm 70 in three different orientations. As can be seen, there are two openings in this member, which allow the pivot arm shaft 72 and the lifter shaft 66 to extend therethrough.

A complete "movement cycle" of the lifter and driver is divided into specific "phases" of movement. If the tool has just driven a fastener, then the driver will be positioned against the piston stop, near the bottommost position of travel along the driver track in the guide body. The driver must then be "lifted" from this "driven position" to its "ready position." Therefore, the lifter rotator is used to move the driver "up" the driver track, and this stage of movement is referred to as the "lifting phase." Once the driver reaches its ready position, it will stay there essentially forever, until the tool's human user decides that it is time to "fire" the tool again. To accomplish that task, the user must press the front "safety element" against the workpiece and also actuate that trigger. When that occurs, the driver is slightly moved upward during a "transition phase" of movement, which ends when the "last" lifter pin releases from contact with the "last" driver tooth. As soon as that physical contact is released, the driver is quickly forced "down," toward the driven position, during a "driving phase" of movement. This action completes the operating cycle for the tool.

FIGS. 9-14 illustrate six different portions of a lift (or "lifting") phase, and clearly illustrate the various steps in the lifting phase that allow the lifter subassembly to properly work to lift the driver, even if the driver has become misaligned at the end of a driving phase. In these six views, certain structural components are illustrated in phantom lines for clarity, so that the lifter disk cam profiles can be readily seen, along with the lifter pins 62; additionally, the driver teeth 92 can be readily seen, along with how the lifter pins engage with the driver teeth.

Figure 9:
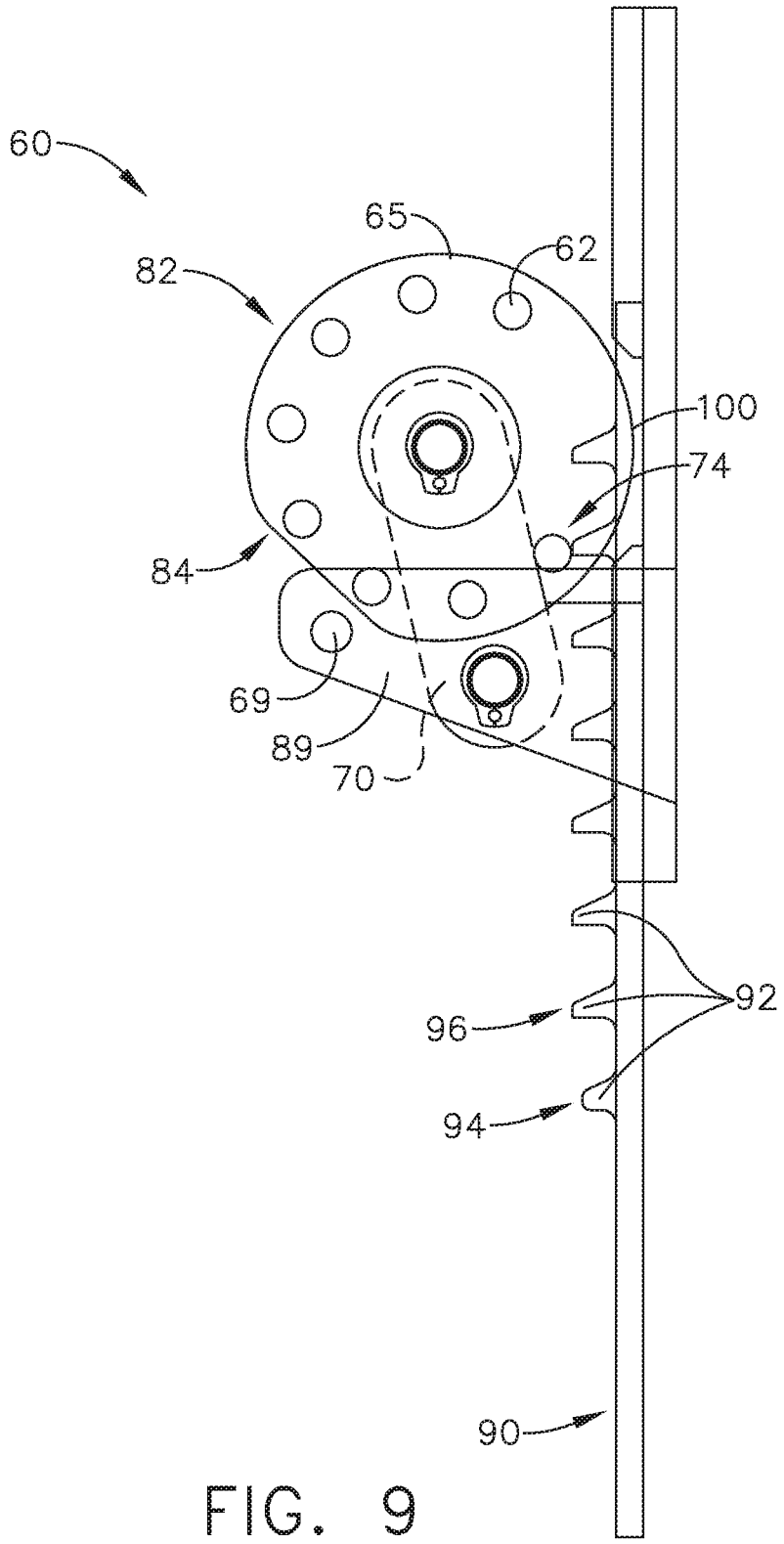
FIGS. 9-14 are several views showing a sequence of steps in a lifting phase of the lifter subassembly of FIG. 1, all in side views with part of the structure in phantom lines for clarity.

Referring now to FIG. 9, this view represents the first portion (a "first predetermined portion") of a lifting phase, showing a situation where the driver 90 has stopped at a misaligned position (i.e., a position that is out of specification for a "proper" lifting phase). As can be seen in this view, a lifter pin 62 is bumping directly against the most extended portion of one of the driver teeth 92, which is illustrated as a "contact point #1," and generally designated by the reference numeral 74.

Another important positional reference is the actual position of the lifter disk 65 with respect to the thickness of the driver 90. As is indicated at the reference numeral 100, this is the position of the lifter disk at rest, and it can be seen that the lifter disk is extended downward (to the right, in this view of FIG. 9). This illustrates the normal position of the lifter pins of the lifter rotator at the beginning of a lifting phase of the driver by the lifter subassembly. However, it will not always be possible to maintain this engagement position (with respect to the distance between the centerline of the driver and the centerline of the lifter rotator) throughout the entire lifting phase, particularly when there is an out-of-specification situation that is about to occur, as in the orientation illustrated in FIG. 9. Another important positional relationship is the cam follower 69; as can be seen on FIG. 9, the cam follower 69 is not presently contacting any of the surfaces of the lifter disk 65.

Figure 10:
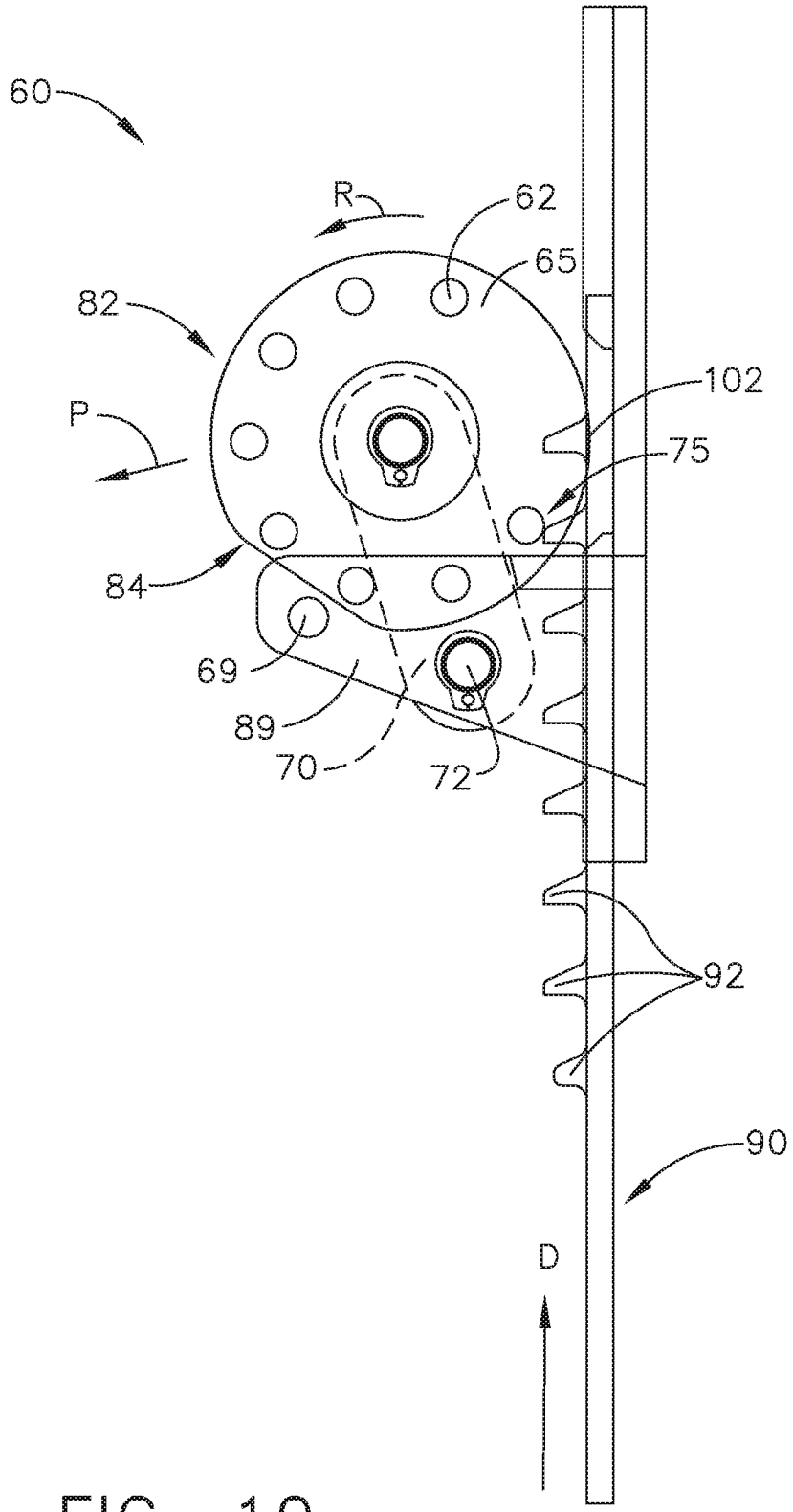

Referring now to FIG. 10, the lifter disks have been slightly rotated, in the rotational direction indicated by the letter "R," and are now attempting to "lift" the driver blade 90 in the linear direction as indicated by the letter "D." Unfortunately, due to the interference between the lifter pin and driver tooth that was illustrated at the reference numeral 74 on FIG. 9, that lifter pin cannot start a successful lift. Therefore, when viewing FIG. 10, it can be seen that the lifter pin is now contacting a different portion of the driver tooth at a contact point #2, generally designated by the reference numeral 75. For this to occur, the lifter subassembly 60 must displace somewhat to the left (in this view of FIG. 10) to allow the lifter pin to slide over the top edge of that driver tooth, so that the original contact point 74 of FIG. 9 does not cause a jam.

In FIG. 10, it can be seen that the pin is beginning to successfully slide over the top portion of the driver tooth (at the contact point 75), and also that the displacement to the left by the lifter subassembly is discernable, from the position of the lifter disk at the reference numeral 102. It can be seen that the entire lifter subassembly 60 has moved to the left (in this view) a few millimeters (as seen by a direction arrow "P"), and therefore the lifter disk 65 only barely overlaps the profile (or thickness) of the driver 90. Of course, the lifter disks 65 and 64 do not literally interfere with the driver 90, because the lifter disks are spaced-apart to the outside of the driver blade portion, which can be seen in the perspective view of FIG. 1. In this view of FIG. 10, the cam follower 69 is still not contacting any surface of the lifter disk, which is due to the fact that the portion of the lifter disk in this orientation is the "flat" profile (or "indented") portion at 84, and this provides some clearance so that the cam follower 69 is not being contacted at this time. The position of the lifter subassembly 60 that is depicted in FIG. 10 approximately shows its maximum displacement in the "P" direction, and that maximum displacement of the pivot arm 70 is sometimes referred to herein as its "second position."

When the lifter subassembly 60 displaces to the left (as seen on FIG. 10) it is actually pivoting about the pivot point 72, which is the pivot arm shaft. Not every component is seen on FIG. 10, but as described above, the lifter disks 64 and 65 both rotate about a lifter shaft 66, and that lifter shaft 66 is mounted to the pivot arms 70 and 71, which also are mounted to the pivot arm shaft 72. The entire lifter subassembly 60 can both rotate (in the direction R) and displace away from the driver 90 (as indicated by the direction arrow "P"), but in this embodiment, it is not a pure linear displacement; instead it is a rotational displacement about the pivot axis 72, which is the centerline of the pivot arm shaft 72. The displacement by the lifter subassembly 60 from the driver 90 represents a "degree of freedom" that allows the lifter to prevent a potential jam between the driver and lifter.

Figure 11:
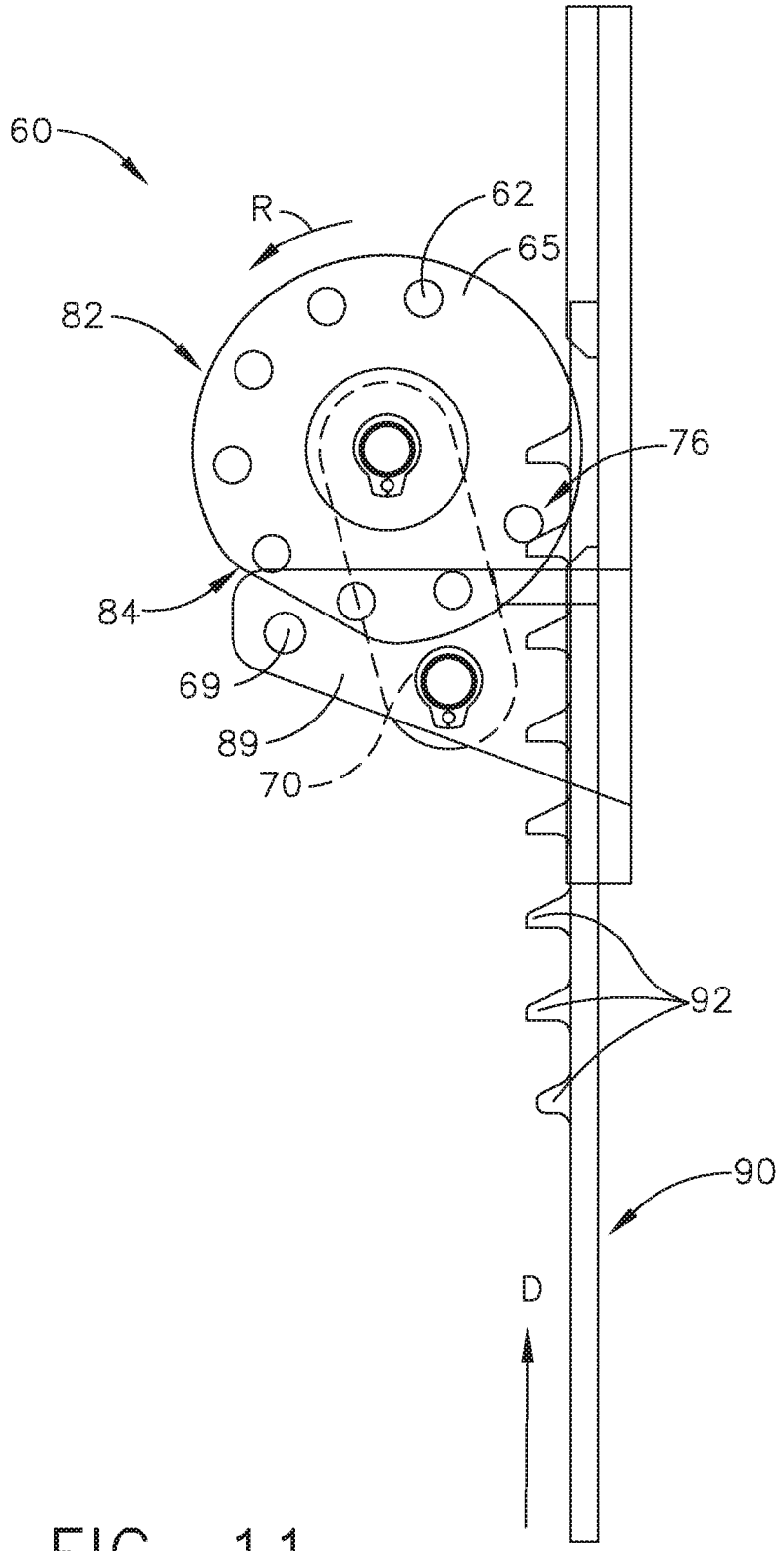

Referring now to FIG. 11, as the lifter disk 65 has continued to rotate in the direction R, the lifter pin has more or less "cleared" the interference situation, and is now sliding down the opposite side of the driver tooth that it was making contact with. In FIG. 11, a contact point #3 is illustrated at the reference numeral 76, and the entire lifter subassembly 60 has now begun to move back to its normal "fully engaged" position, in which the profile of the lifter disk 65 is positioned at a point that is about half-way through the thickness of the driver 90. At this time in the rotation of the lifter disk, there is still no contact between the cam follower 69 and the external surfaces of the lifter disk 65, again due to the fact that the flat portion of the cam profile at 84 provides this clearance.

Figure 12:
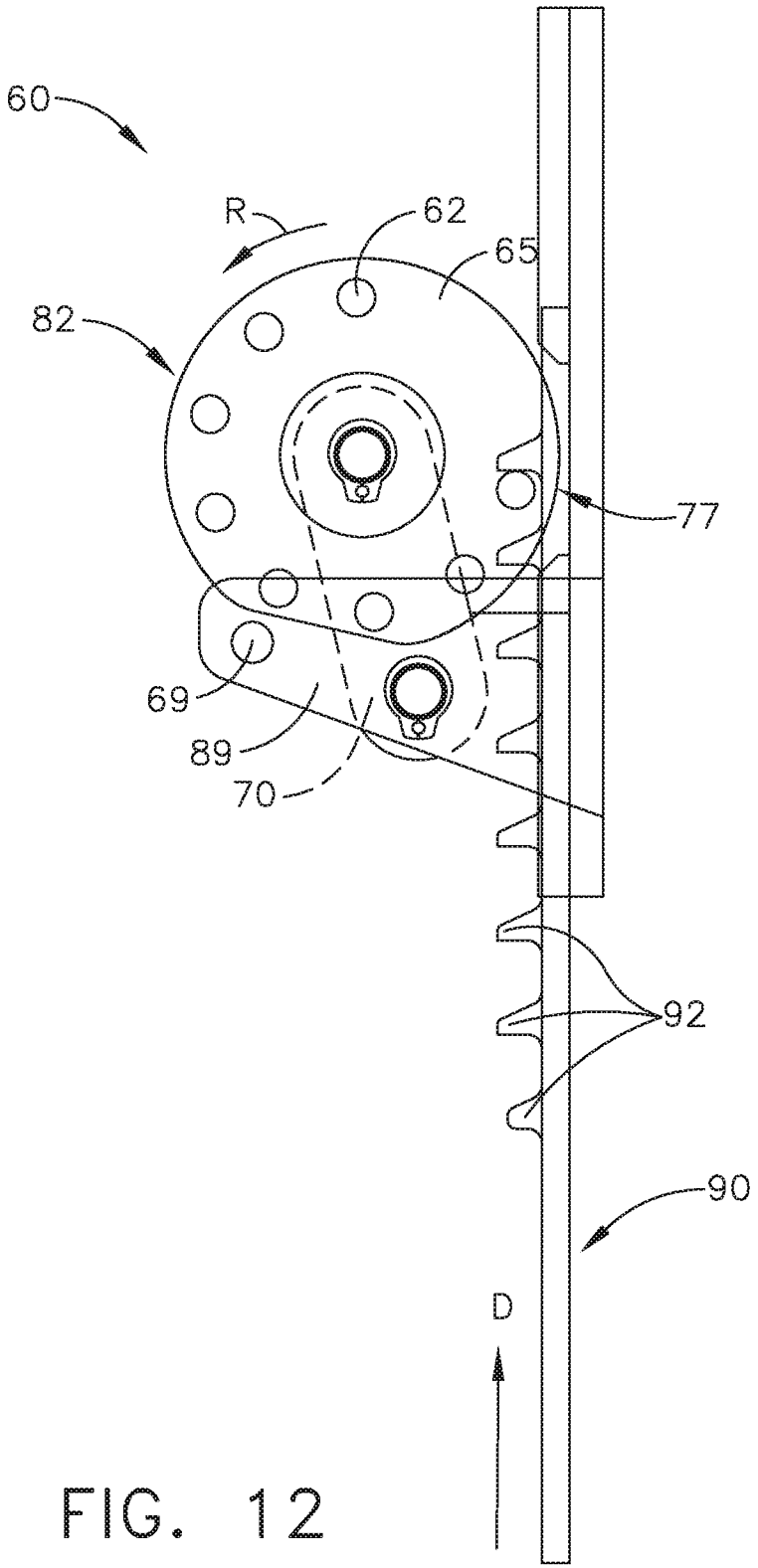

Referring now to FIG. 12, the lifter disk 65 has continued to rotate in the rotational direction R, and the lifter pin has continued to rotate to the point where it is now engaging the bottom surface (in this view) of the "next" driver tooth, which is illustrated at the contact point #4, at the reference numeral 77. The entire lifter subassembly 60 has now displaced back to its "normal" engaging (or engagement) position, in which the lifter disk appears to be interfering with the driver blade at its original thickness (which was position 100 on FIG. 9). In the orientation illustrated in FIG. 12, the cam follower 69 is still not contacting the outer surface of the lifter disk 65, again due to the flat portion 84 of the cam profile.

Figure 13:
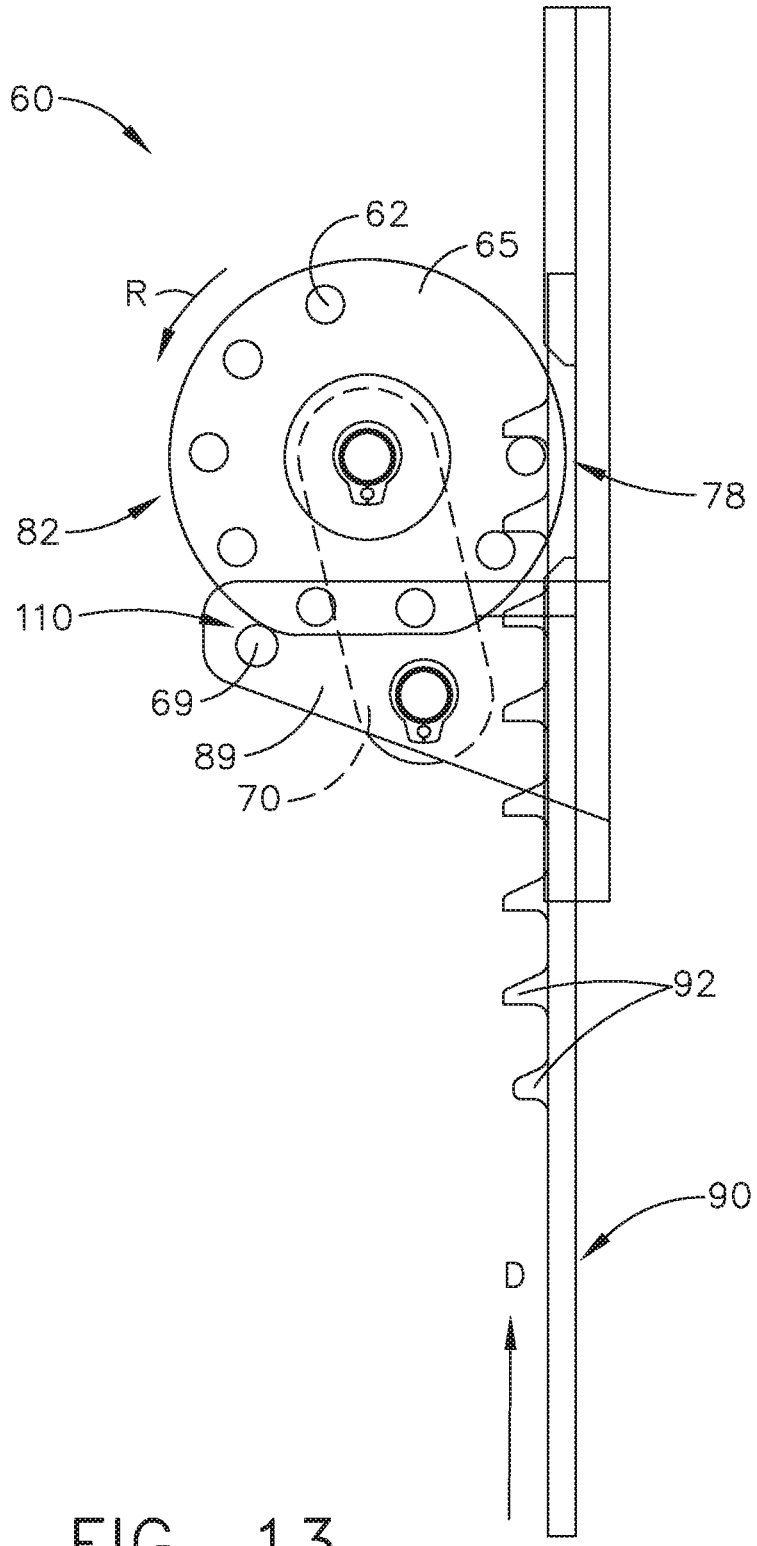

Referring now to FIG. 13, the lifter disk 65 has continued to rotate, and its lifter pin is now "lifting" the driver 90 and is making contact with the "next" driver tooth at the contact point #5, as indicated at reference numeral 78. In this view, the cam follower 69 is finally making contact with the outer surface of the lifter disk 65, and that contact point is indicated at the reference numeral 110. The rotational (or pivotable) position of the lifter subassembly 60 has displaced back to its fully engaged position, in which the lifter disk 65 appears to be interfering with the driver thickness at about two-thirds distance, similar to the position 100 on FIG. 9. As can be seen in this view, the round portion 82 acts as a "third contacting surface" as it makes physical contact with the cam follower.

Figure 14:
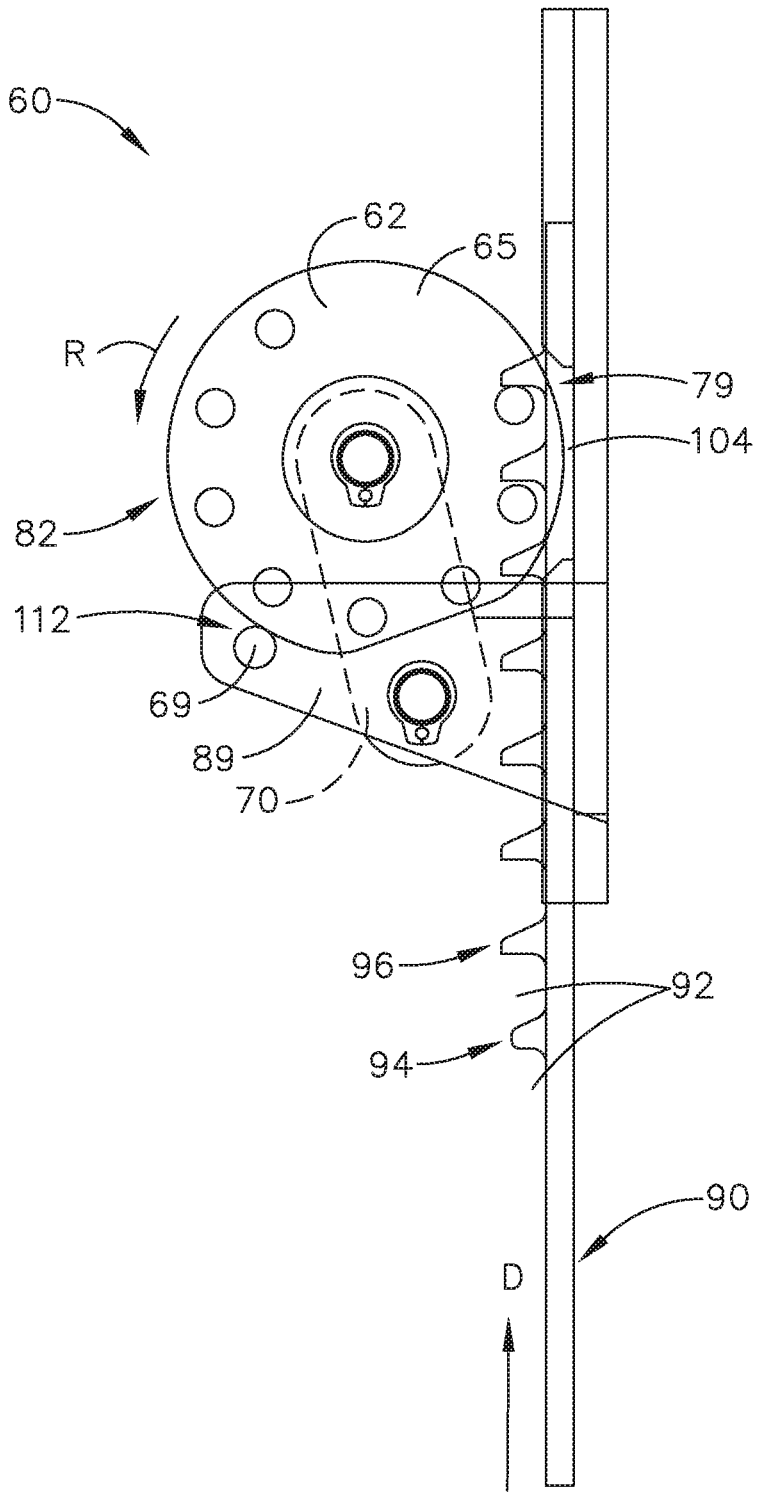

Referring now to FIG. 14, the rotation of the lifter disk 65 has continued in the direction R, and the "lift" of the driver 90 has continued, such that the lifter pin is contacting the driver tooth at a contact point #6, generally designated by the reference numeral 79. The "second" lifter pin is about to contact the second driver tooth, and the position of the lifter subassembly 60 is still fully engaged and appears to be interfering with the driver 90 at a position that is about two-thirds of the driver thickness, as seen at reference numeral 104. The cam follower 69 is still making contact with the outer surface of the lifter disk 65 at the reference numeral 112. This contact between the cam follower 69 and the outer portion of the lifter disk 65 will continue throughout the remainder of the lifting phase, because the round (or arcuate) portion of the cam profile at 82 will continue to contact the cam follower 69.

The cam follower 69 acts as a retainer to prevent the lifter subassembly 60 from pivoting away from the driver throughout the remainder of the lift. In this state, the pivot arm shaft 72 will be constrained from pivoting the pivot arms 70 or 71, because of the contact by the cam follower 69, which acts as a retainer to "retain" that contact between the lifter subassembly 60 and the engaged position with the driver. This operating state continues throughout the rest of the portion of the lifting phase until the lifter has completed its rotation, and the constraining effect of the retainer 69 will continue until it is time for a new transition phase and then a new driving phase, to drive a fastener from the tool. After the next driving phase has occurred, another lifting phase can occur and, if the driver ends up "out of spec" once again, the tool will be back to the state illustrated in FIG. 9.

Figure 15:
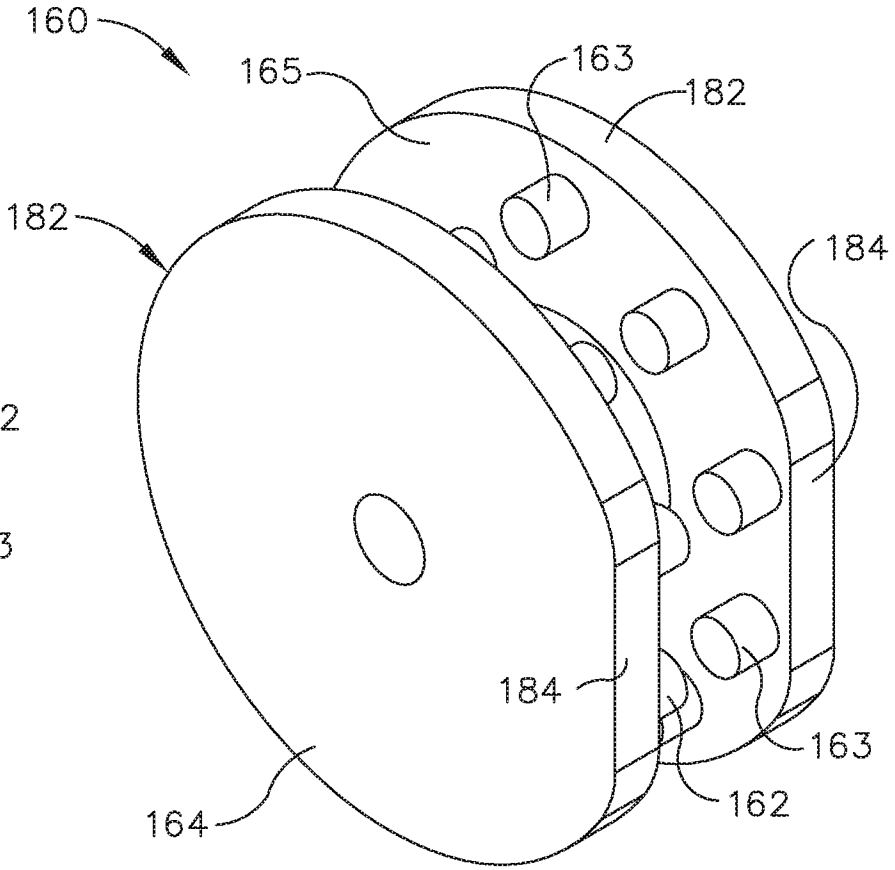
FIG. 15 shows two views of a second embodiment lifter subassembly, which uses individual lifter pins per lifter disk, as constructed according to the principles of the technology disclosed herein.
Figure 15:
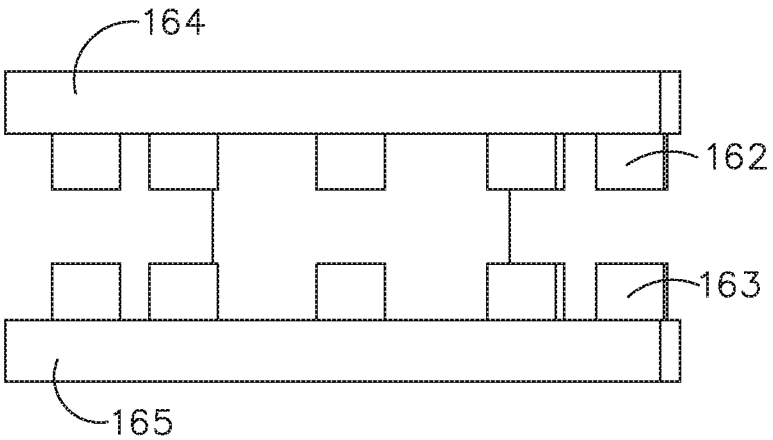

Referring now to FIG. 15, a second embodiment of a lifter subassembly is illustrated, generally designated by the reference numeral 160. The lifter subassembly 160 includes a pair of parallel lifter disks 164 and 165, which are similar to the previously described disks 64 and 65 that are illustrated on FIG. 1. The lifter pins of this new embodiment are different, however, since they do not extend all the way across, between the two lifter disks. Instead each lifter disk has its own set of lifter pins, which are designated by reference numerals 162 and 163. The lifter pins 162 are mounted to the lifter disk 164, while the lifter pins 163 are mounted to the lifter disk 165.

Both lifter disks have a cam profile, in which the round (arcuate) portion of the cam profile is designated at the reference numeral 182, and the flat (indented) portion of the cam profile is designated at the reference numeral 184. These cam profiles are essentially identical to the cam profiles 82 and 84 on the lifter disks 64 and 65 of the first embodiment, as illustrated in FIGS. 1-14.

Some, or all, of the lifter pins 162 and 163 can have rollers installed thereon, if desired by the equipment designer. Such rollers are not specifically illustrated on FIGS. 15-17; however, in all cases, the lifter pins 162 and 163 may include such rollers.

Figure 16:
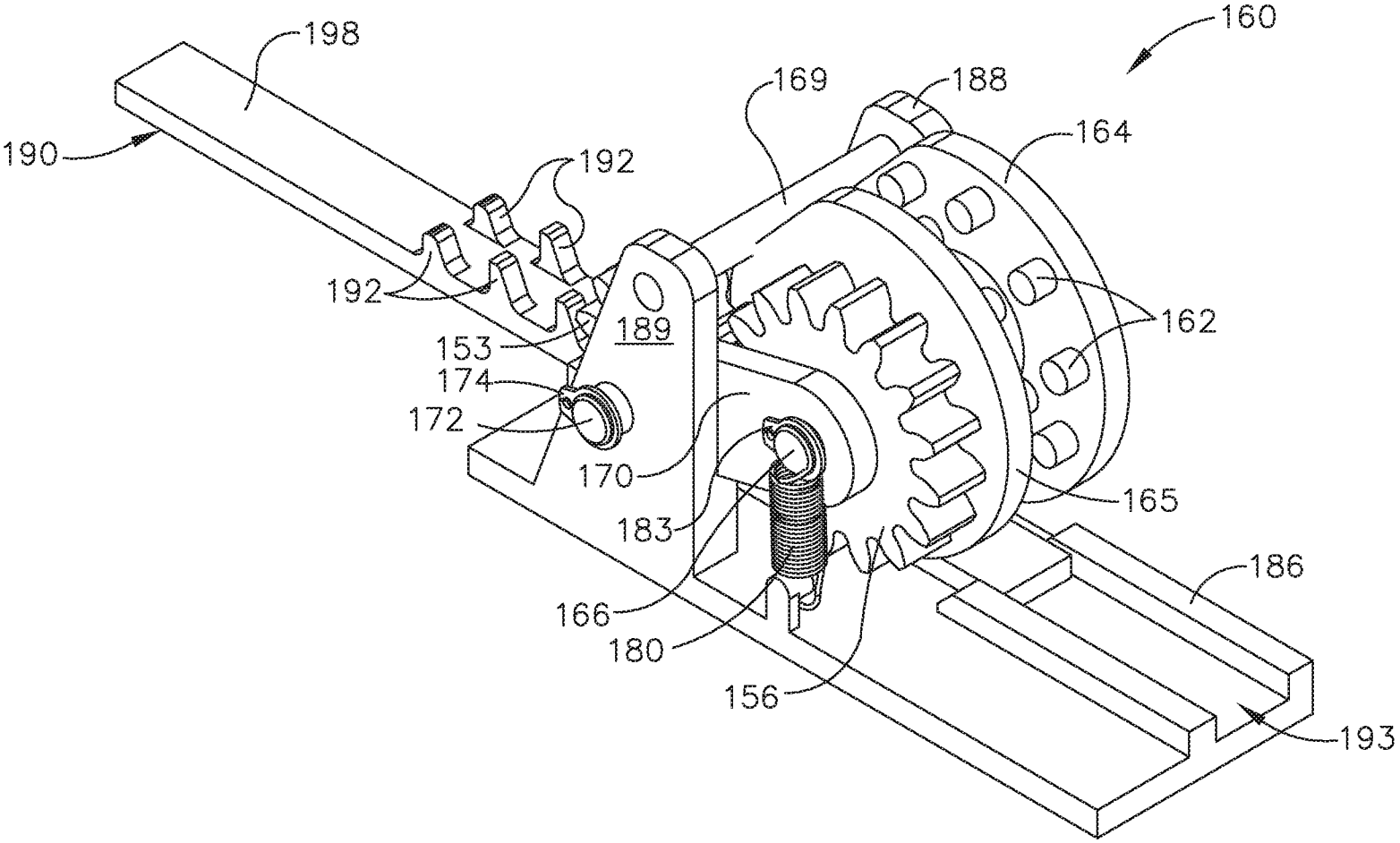
FIG. 16 is a perspective view from above and to one side of the second embodiment lifter subassembly of FIG. 15.

Referring now to FIG. 16, the second embodiment lifter subassembly 160 is illustrated, as being positioned on a lifter shaft 166. Lifter shaft 166 is mounted to a pair of pivot arms 170 and 171 (see FIG. 17), which in turn are mounted to a pivot arm shaft 172, which is then mounted on a pair of parallel brackets 188 and 189. The parallel brackets 188 and 189 are part of a lifter base 186, which includes a driver track 193.

A driver 190 is movable within the driver track 193, and the driver has multiple teeth 192. A cam follower ("retainer") 169 is mounted in the parallel brackets 188 and 189. As the lifter rotator 160 rotates, the cam follower 169 will make contact with the curved (or round) portion 182 of the perimeter surface of the pair of lifter disks 164 and 165, but will not make contact with the flat (indented) portion of the cam profile at 184.

The lifter shaft 166 is biased by an extension spring 180, so that, under normal circumstances, it is forced to engage the lifter pins 162 and 163 against the driver teeth 192 of the driver 190. However, as described above in relation to the first embodiment of FIGS. 1-14, if the driver is stopped at a position that is out of specification, then one of the lifter pins 162/163 may contact a driver tooth 192 at a position that will not successfully engage with that lifter pin. If that occurs, the pivot arms 170 and 171 will be allowed to displace (or pivot) away from the driver 190, and that will prevent a jam from occurring between the lifter subassembly and the driver. The overall lifting mechanism of the second embodiment works essentially the same as the overall lifting mechanism of the first embodiment, in this regard.

In the event described in the previous paragraph, as the lifter continues to rotate, that "first" lifter pin 162/163 will be forced to "drop" into the gap between that initial driver tooth 192 and the "next" driver tooth 192. (See the contact point 77 on FIG. 12, for example.) At that point of the lifting phase, the continued rotation of the lifter rotator 160 will cause that "first" lifter pin to begin lifting the driver 190, due to physical contact between that "first" lifter pin and the engaged "next" driver tooth 192. In this manner, the lifter rotator 160 will successfully force the driver 190 upward to create a complete lifting phase, while avoiding a jam condition from occurring.

There is a drive gear 153 that engages the lifter gear 156, and the motion of the drive gear will cause the lifter subassembly 160 to rotate, thereby forcing the driver 190 to move in a lift (or lifting) phase, which will cause the driver to be moved to a "ready" position where it can again drive a fastener from the fastener driving tool.

Figure 17:
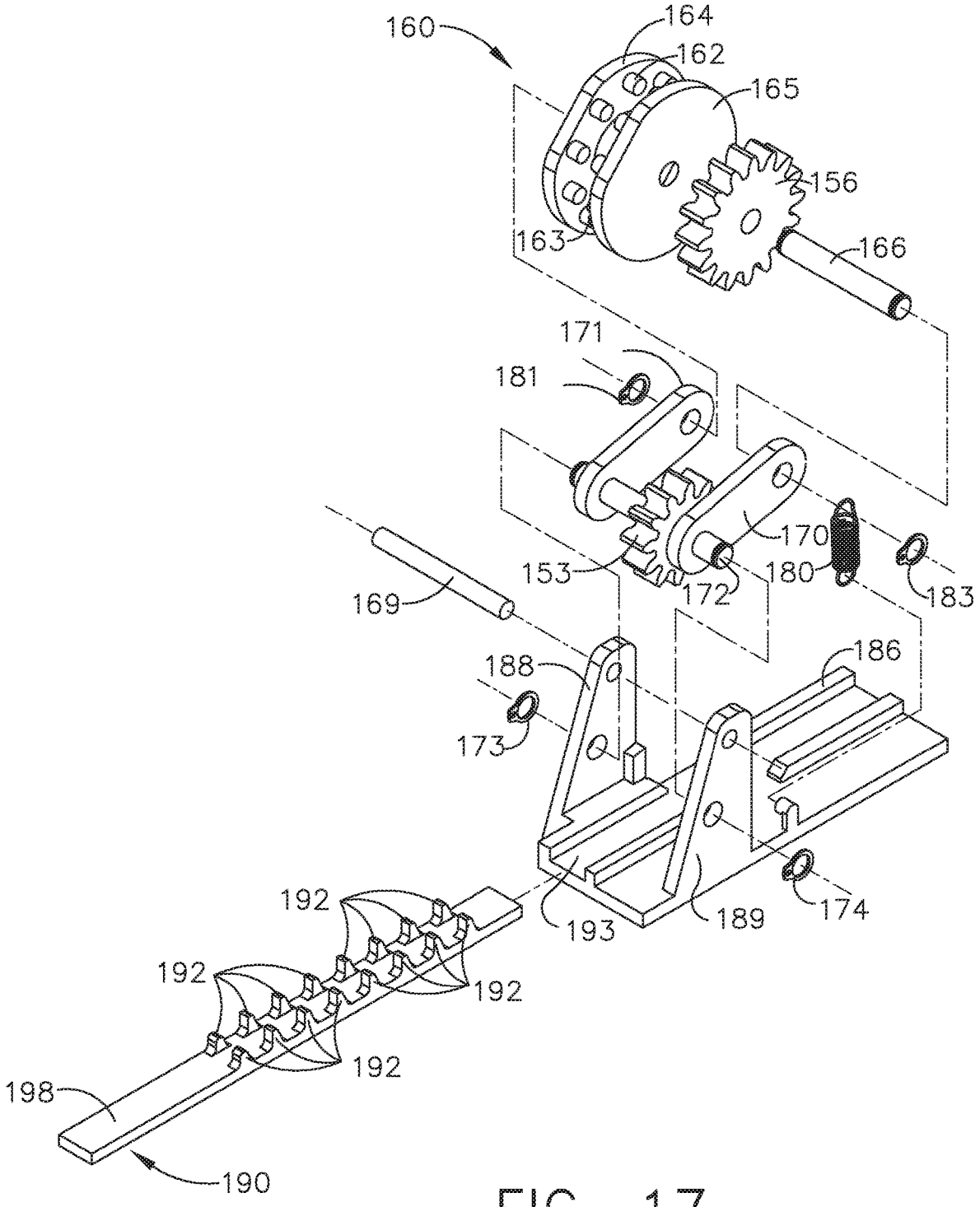
FIG. 17 is an exploded view of the second embodiment lifter subassembly of FIG. 15.

Referring now to FIG. 17, the second embodiment is presented in an exploded view, which shows a lifter subassembly 160 that includes the pair of lifter disks 164 and 165, two different sets of lifter pins 162 and 163, and the lifter shaft 166 that runs through openings in the lifter disks and also runs through a central opening of the lifter gear 156. A pair of snap rings 181 and 183 hold the lifter shaft in place, and the extension spring 180 biases the lifter shaft toward the driver base 186.

The driver base 186 has a pair of extensions that act as brackets 188 and 189. These brackets hold the cam follower 169 and also hold the pivot arm shaft 172 in position. Also mounted to the pivot arm shaft are the two parallel pivot arms 170 and 171, and the drive gear 153. Two snap rings 173 and 174 hold that shaft to the pivot arms 170, 171.

The driver 190 includes eight pairs of driver teeth 192 which extend from the driver's planar surface at 198. The lifter pins 162 and 163 are configured to physically engage these eight pairs of driver teeth 192 in a manner so as to equally share the mechanical loading forces on each pair of driver teeth as they become engaged with one of the pairs of lifter pins 162/163. In other words, the lifter pins 162/163 are positioned along the longitudinal centerline of the driver 190, and the driver teeth 192 are also positioned substantially equidistant from that same longitudinal centerline of the driver 190. Therefore, this arrangement of the two sets of lifter pins 162/163 physically engaging the pairs of driver teeth 192 will tend to substantially balance the mechanical loading forces on the driver 190, during a lifting phase.

The two embodiments described above each use a cam follower that acts as a retainer. In the first embodiment, the cam follower is reference numeral 69, whereas in the second embodiment the cam follower is reference numeral 169. In both instances the cam follower will not contact the outer surface of the lifter disks if the "flat" (indented) portion of the cam profile of those lifter disks is facing the cam follower. Only when the "round" (arcuate) portion of the cam profile of the two lifter disks is facing the cam follower will contact be made between the cam follower and the lifter disks. At the beginning of each lifting phase, the flat portion of the cam profile of the lifter disks will be facing the cam follower, and therefore, that indented portion will allow the entire lifter subassembly (either 60 or 160) to displace away from the driver teeth 92 or 192, if necessary. This occurs during the "first predetermined portion" of the lifting phase. As illustrated in FIGS. 9-14, that displacement can become necessary in a situation where the driver 90 stops at an undesirable position; but when that occurs with this new design, there will not be a jam because the lifter subassembly is able to displace away from the driver.

Unfortunately, there can be other mechanical loading forces that may cause the lifter subassembly to attempt to displace away from the driver at times where that displacement would be undesirable. One of those situations is at the end of the lifting phase, where the "last" driver protrusion (which is at position 94 on FIG. 2) becomes the final protrusion to be contacted by one of the lifter pins 62 during the next transition phase. When that lifter pin 62 engages this final or "last tooth" at position 94, there is no other driver tooth and no other lifter pin to accept some of the loading forces that occur on these parts, because these are the final engaging structures at the end of the lifting phase, and at the beginning of a transition phase. When the "final" driver tooth at position 94 and lifter pin 62 are mechanically engaged, the force vectors can change to the point where the sideways (or horizontal) force becomes greater than the lift (or vertical) loading force, and this tends to force the movable portion of the lifter subassembly to displace away from the driver about the pivot axis on pivot shaft 72. These loads need to be contained by the retainer 69 and the contact face on at least one of the lifter disks by the substantially round profile 82. That containment will prevent sudden movement by the movable portion of the lifter subassembly, will provide additional surety against sudden driving of the tool's driver if the tool is dropped or otherwise bumped, and also generally provides for a reliable release position for the driving phase.

This "last" (or "final") lifter pin and "last" driver tooth are mechanically engaged during the time the driver is at its "ready" position. However, at the beginning of a driving cycle, the lifter must again rotate in a manner that additionally lifts the driver 90 "upward" a small distance, before that "last" driver tooth is allowed to physically release from that "last" lifter pin. This is a transition phase of driver movement that occurs before the beginning of every driving phase, in the illustrated embodiment. At this transition phase, the force vectors can change to a point where the sideways (or horizontal) force becomes greater than the lift (or vertical) loading force, and this tends to force the lifter pivot arms to displace away from the driver. These loading forces need to be contained near the top of the driver's travel.

The cam follower 69 on FIG. 1 will engage mechanically (make physical contact) against the rounded portions 82 of the cam profile surfaces of the two lifter disks 64 and 65 during this "second predetermined portion" of the lifting phase. This mechanical contact prevents the lifter subassembly 60 from displacing away from the driver 90, thus preventing any kind of unfortunate (or accidental) firing of the driver that might be caused if the lifter subassembly 60 would be allowed to displace away from the driver track at the end of a lifting phase. Due to these loading forces described above, the cam follower 69 acts as a retainer to hold the lifter subassembly in its appropriate position during the transitional phase of the tool's operating cycle. The cam follower 69 (or 169) can be allowed to rotate, if desired, so that it can "roll" over the "third contacting surface" of the arcuate perimeter 82 of the lifter disk(s).

It will be understood that, in situations where the driver has become mispositioned at the end of a driving phase—i.e., its stopping position is out of specification—then the "first" lifter pin will attempt to move past the "first" driver tooth that is encountered in a manner that will not cause a jam. If that lifter pin has no roller, then it will likely engage with that driver tooth in a sliding relationship (i.e., it will "slide along" the tooth) as it attempts to move past that first driver tooth. However, if that lifter pin does have a roller, then the lifter pin can engage with that driver tooth either in a sliding relationship or in a rolling relationship (i.e., it will "roll over" the tooth), as it attempts to move past that first driver tooth.

Figure 18:
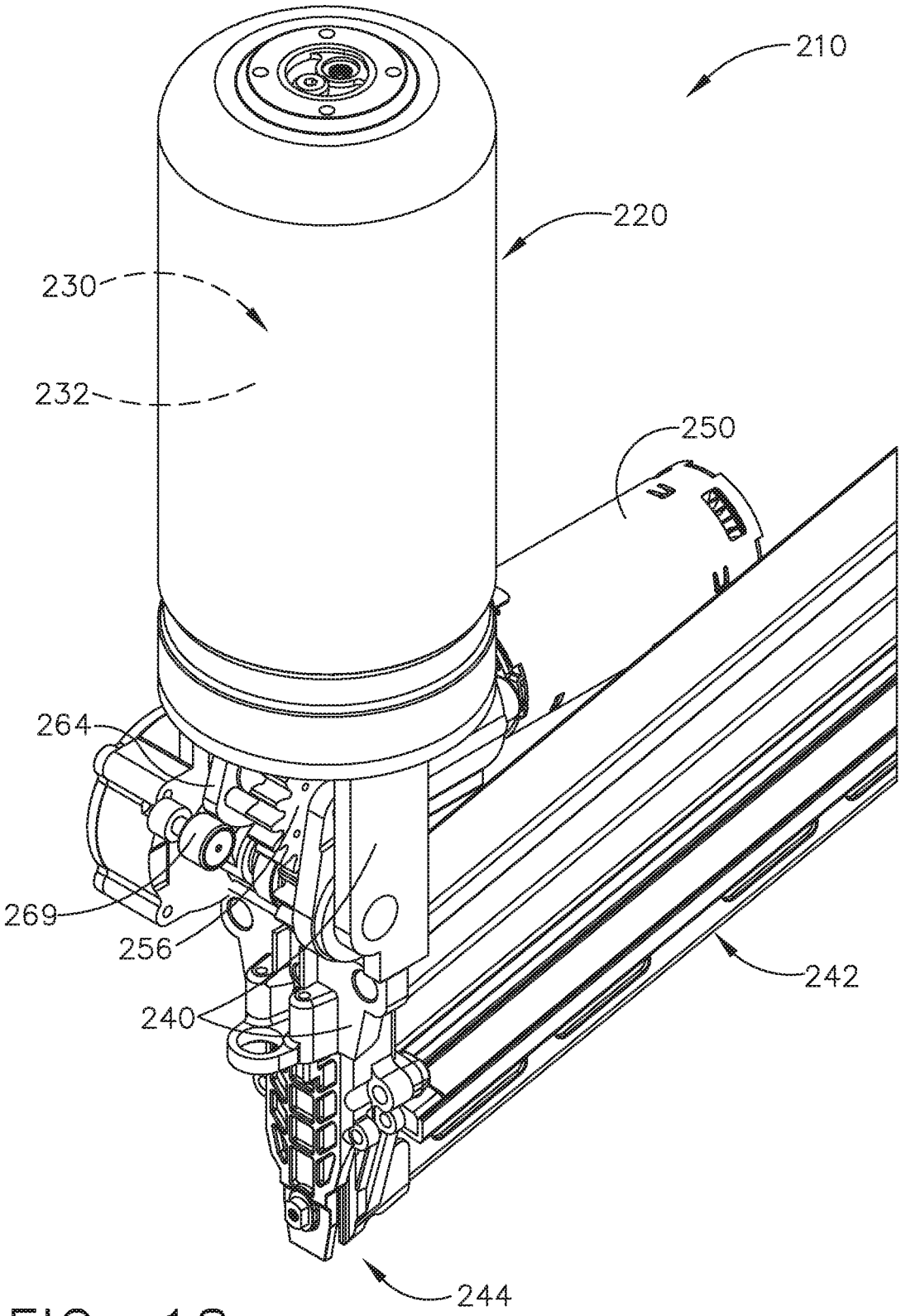
FIG. 18 is a perspective view from above and to one side of a driver assembly for a framing nailer tool, as constructed according to the principles of the technology disclosed herein, and illustrates a third embodiment lifter subassembly.

Referring now to FIG. 18, a framing nailer tool is illustrated, generally designated by the reference numeral 210. Nailer tool 210 includes a pressure chamber 220 that includes a cylinder 230 with a movable driver actuation device, which is a piston 232 in this illustrated embodiment. The movable piston 232 is connected to a driver member (or "driver") 290 (see FIG. 19) that, when actuated, drives a fastener from a magazine 242. A piston stop 234 (see FIG. 19) absorbs the force of the piston 232 at the end of a "driving phase." The tool 210 includes a guide body 240, an electric motor 250, a gearbox 252 that receives the output shaft from the electric motor, and gear train gears 254 (including a bevel gear) that receive the output from the gearbox 252. The gear train gears 254 also include a "drive" gear 253, and a "lifter" gear 256 (see FIGS. 19 and 20). It should be noted that the first two embodiments illustrated on FIGS. 1-17 will also be used with a similar pressure chamber, and other components illustrated on FIG. 18.

The electric motor 250 is commanded to rotate by an electronic controller (not shown) when it is desired to lift the combination piston 232 and driver member 290 from their "driven position" to their initial drive or "ready position." As will be explained below, when the lifter gear 256 rotates, via action of the electric motor 250, there are mechanical components that force the driver member 290 upward (in the view of FIG. 18), during a "lifting phase", so that the piston is also moved further into the pressure chamber 220, which is where the piston will remain at the "ready position," until it drives the next fastener.

When a "driving phase" is to occur, the motor 250 again rotates (in the same direction), which causes the lifter rotator's movement to enter a transition phase that releases the driver 290 from contact with a lifter subassembly 260. This allows the pressurized gas in the pressure vessel 220 and cylinder 230, to quickly force the piston 232 downward (in this view), while driving a fastener supplied by the magazine 242 out an exit end 244 of the tool, and into a workpiece (not shown).

The driver 290 is elongated, and is generally "blade-like" in shape. It moves through a linear "drive track" (not shown) that is formed inside the guide body 240. Guide body 240 generally comprises a main "chassis portion" 236 (see FIG. 19) and a lower "exit portion" 238. Such fastener drive tools typically have a safety contact element mounted to the exit portion, which ensures that the exit end 244 is pressed against a solid object before the controller allows the tool to begin a driving phase. Such tools also typically have an outer housing that contains the electronic controller and the trigger, as well as a mounting location for a battery pack. Those components have been removed from the drawings herein, for clarity of the lifter subassembly and other components illustrated herein.

It should be noted that the general layout of the components of the framing nailer viewed in FIG. 18 is very similar to the general layout of the first and second embodiments, described above in reference to FIGS. 1-14 (for the first embodiment) and FIGS. 15-17 (for the second embodiment). For example, the driver gear 53 on FIG. 1 generally corresponds to the driver gear 253 on FIG. 18; also, the lifter disk 64 on FIG. 1 corresponds to the lifter disk 264 on FIG. 18, and the retainer (or cam follower) 69 on FIG. 1 corresponds to a 269 on FIG. 18; further, the driver 90 on FIG. 1 corresponds to the driver 290 on FIG. 19.

Figure 19:
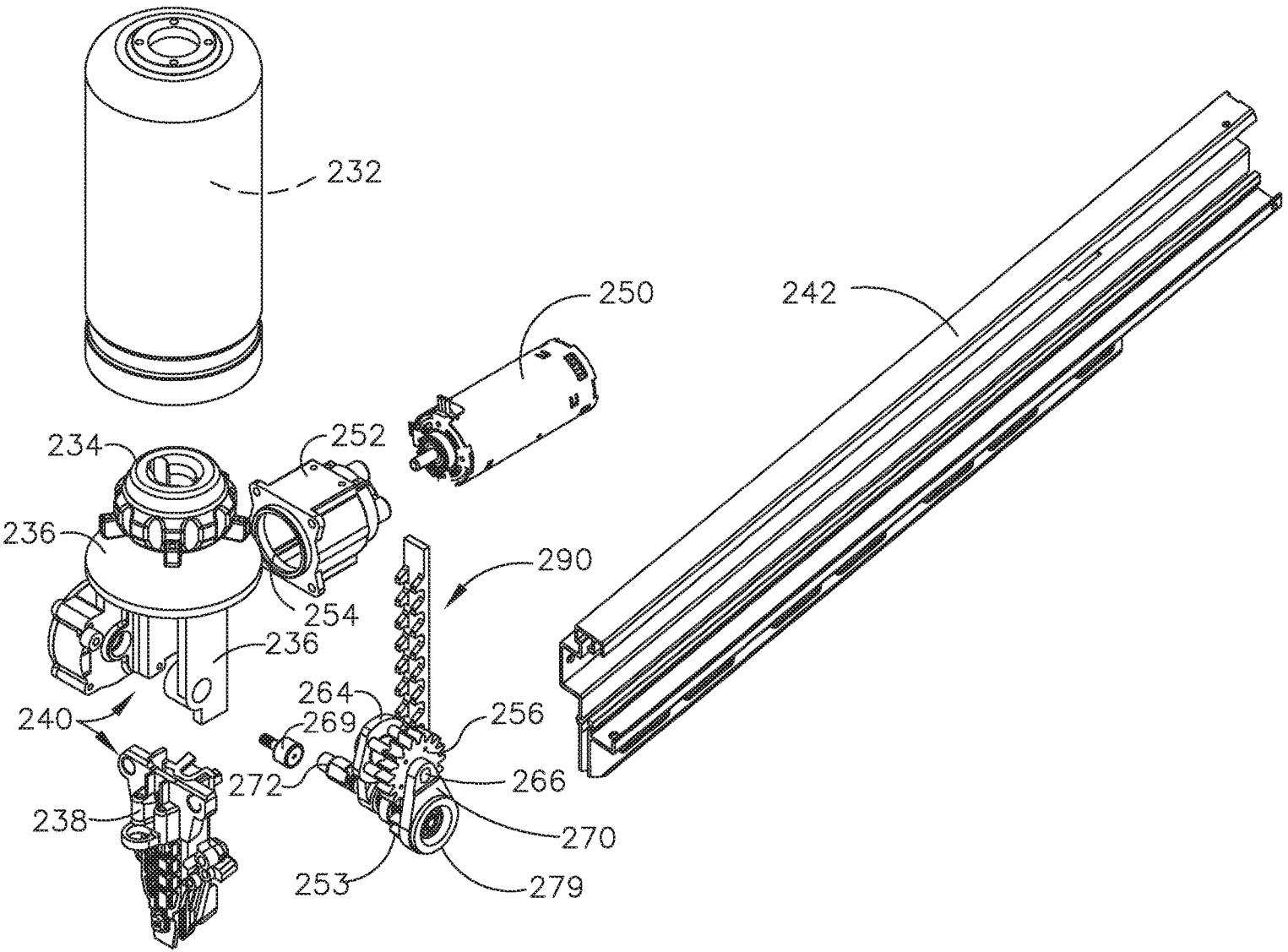
FIG. 19 is an exploded view of the third embodiment driver assembly of FIG. 18.
Figure 20:
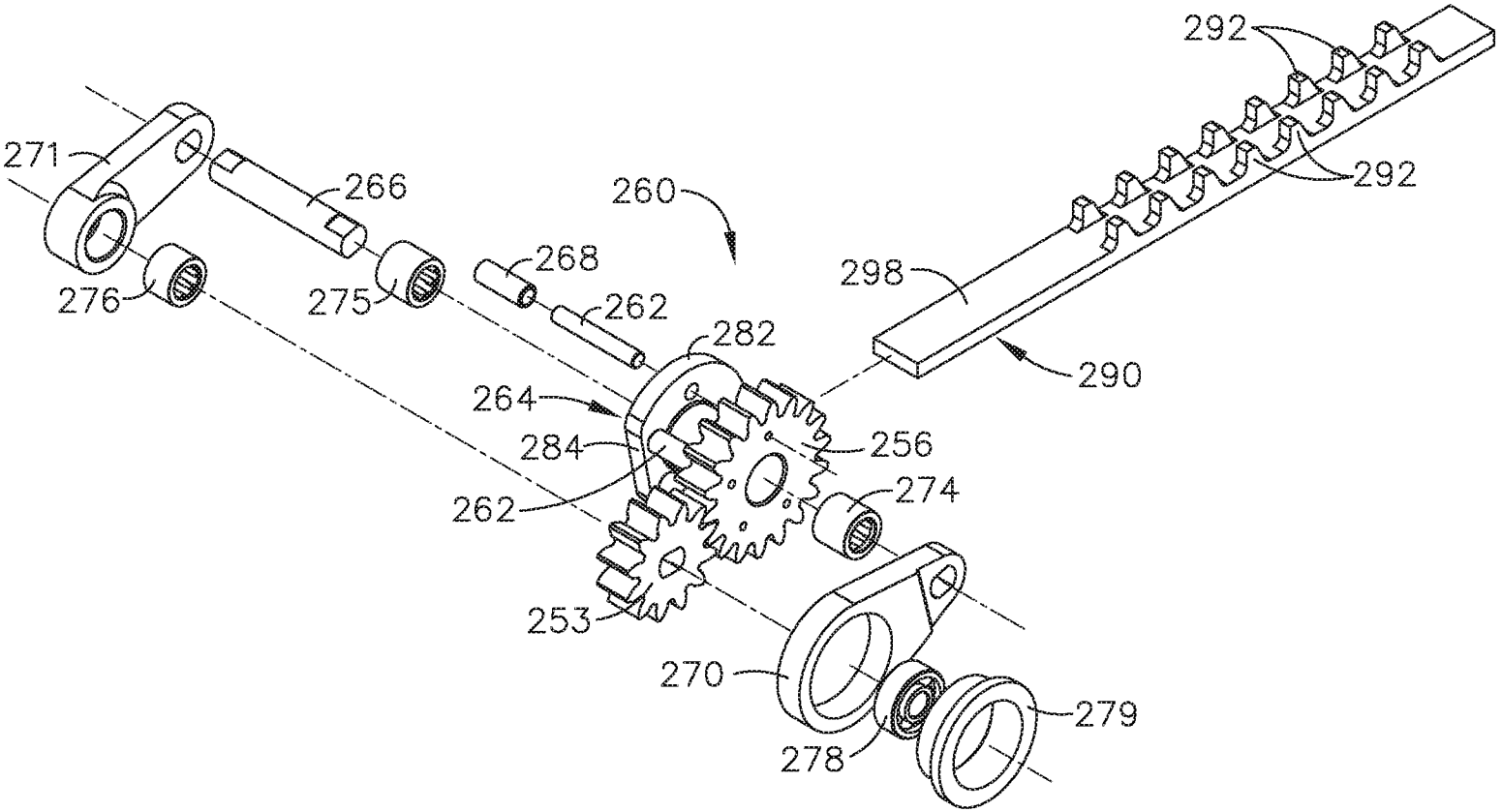
FIG. 20 is an exploded view of the third embodiment lifter subassembly used in the driver assembly of FIG. 18.

Referring now to FIGS. 19 and 20, these two views show more details of the lifter subassembly 260. Lifter subassembly 260 includes a lifter shaft 266 that extends through a "drive side" pivot arm 270, a first needle bearing 274, the lifter gear 256, a lifter disk 264, a second needle bearing 275, and a second pivot arm 271. The lifter disk 264 and the lifter gear 256 both rotate together about this lifter shaft 266. There are multiple "pins" 262 that extend between the lifter disk 264 and the lifter gear 256. (Note that, in this third embodiment, there is only a single "lifter disk" at 264.) The pins 262 essentially perform the same lifting functions that the lifter pins 62 perform in the first embodiment lifter subassembly 60, as described above. On FIG. 20, one of the lifter rollers is illustrated at 268; in this embodiment, all lifter pins 262 include such rollers.

The two pivot arms 270 and 271 both are able to rotate about a pivot arm shaft 272; the centerline of shaft 272 is the pivot axis of these two pivot arms 270 and 271. Pivot arm shaft 272 also extends through a needle bearing 276 (near pivot arm 271), the drive gear 253, a roller bearing 278 (near the drive side pivot arm 270), and a bushing 279. Both pivot arm 270 and 271 generally rotate together, because they both extend to lifter shaft 266.

As noted above, both the lifter gear 256 and the lifter disk 264 have lifter "pins" 262 that extend from the lifter gear and the lifter shaft at approximately right angles to the circular plane of the disk 264 or gear 256, respectively. In other words, the lifter gear and lifter disk comprise rotatable disks that each have a "first contacting surface" (i.e., the plurality of lifter pins extending from a surface of those rotatable disks), and it is the action of these lifter pins 262 that engages a "second contacting surface" of the driver 290 to force it upward, from its driven position to its ready position. Those lifter pins 262 are visible on FIGS. 18-20.

The lifter disk 264 has an outer perimeter that exhibits a cam profile, similar to the cam profiles of the lifter disks 64, 65, 164, and 165, discussed above in reference to FIGS. 1-17. Disk 264 similarly has a rounded portion at 282, and a flat or "straight line" portion at 284. A retainer 269 (see FIG. 18) is used in the same manner as the retainer 69, discussed above in connection with FIGS. 1-14. In FIG. 19, the retainer 269 has the shape of a cam follower; however, retainer 269 does not "follow" the cam profile of the outer perimeter of the disk 264. Instead, the retainer is firmly mounted to the guide body, and is thus held in place.

If the flat portion 284 is facing the retainer 269 (i.e., the flat portion is proximal to the retainer), then in that "first state," there will be a gap between the outer surface of the retainer 269 and the outer surface of the lifter disk flat portion, and thus the lifter disk 264 will be able to displace away from the driver 290 during the initial portion of a lifting phase, if necessary to prevent a jam (as in FIGS. 9-12, herein). Later in the lifting phase, the lifter disk 264 will have rotated to the point where the retainer 269 will be proximal to the rounded portion 282 of the lifter disk, and in that second state, the outer surface of the retainer will be in contact with the outer surface of the lifter disk, and thus the lifter disk 264 will be unable to displace away from the driver 290 (as in FIG. 14, herein).

It will be understood that the lifter gear 256, as it is mounted on the lifter shaft 266, has the general form of a "disk." In other words, the lifter gear 256 has sufficient outer size as compared to the lifter disk 264 so that both the gear 256 and disk 264 have the same types of extensions from their surface areas, which are the lifter pins 262. For this to be true, both the lifter disk and lifter gear must act as rotating "disks" so that each one of these components can have the lifter pins mounted thereto at the same base circle diameter. Of course, the lifter gear 256 exhibits external gear teeth along its outer perimeter edge so as to engage with the drive gear 253; whereas the lifter disk 264 exhibits a smooth outer perimeter edge, so that the retainer 269 can either roll or slide against that smooth outer perimeter edge, and act as a cam follower during much of the rotational movement of that lifter disk.

On FIG. 20, the driver 290 is illustrated in greater detail. Driver 290 includes a plurality of driver "teeth" at 292, which protrude from a planar surface 298. As noted above, the profile of the protruding driver teeth 292 can all be identical, or the profile of certain teeth 292 can somewhat vary, if desired by the tool's designer.

The third embodiment illustrated on FIGS. 18-20 uses a smaller lifter disk with only four lifter pins 262, and therefore, the lifter rotator 260 (which includes both the lifter disk 264 and the lifter gear 256) must make two complete rotations to create a complete lifting phase. A latch (not shown) is provided to hold the driver 290 from "driving" downward (in the views of FIGS. 18 and 19) at the half-way point of the lifting phase, in a similar fashion to earlier Senco designs that have been disclosed in earlier patent publications (see the list of patent documents, below, that are incorporated by reference). On the other hand, the first and second embodiments illustrated on FIGS. 1-17 both use a larger lifter disk that has eight lifter pins 62 or 162, and that lifter rotator only requires a single rotation to create a complete lifting phase. Both single-rotation and double-rotation lifter rotator designs will work to prevent jams, as disclosed herein. It should be noted that, in this third embodiment, the design of the biasing scheme should be of sufficient force to maintain engagement between the lifter pins 262 and the driver teeth 292 during the entire second rotation of the lifter rotator 260, including during the portion of the second rotation when the retainer 269 is not in contact with the lifter disk outer perimeter 282.

Figure 21:
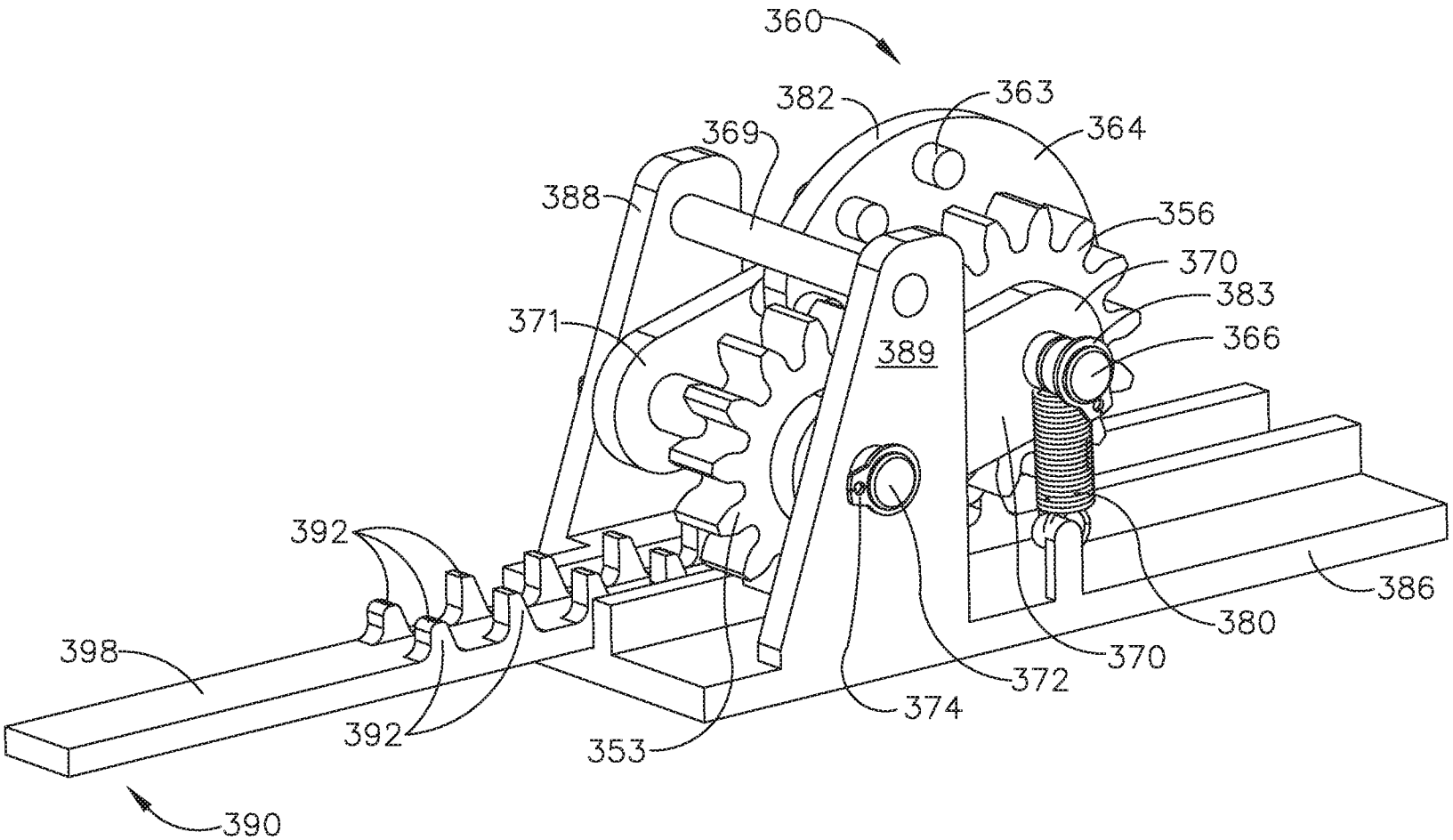
FIG. 21 is a perspective view of a fourth embodiment lifter subassembly, which uses a single lifter disk with lifter pins extending from both sides of the lifter disk, as constructed according to the principles of the technology disclosed herein, showing the side having the lifter gears.
Figure 22:
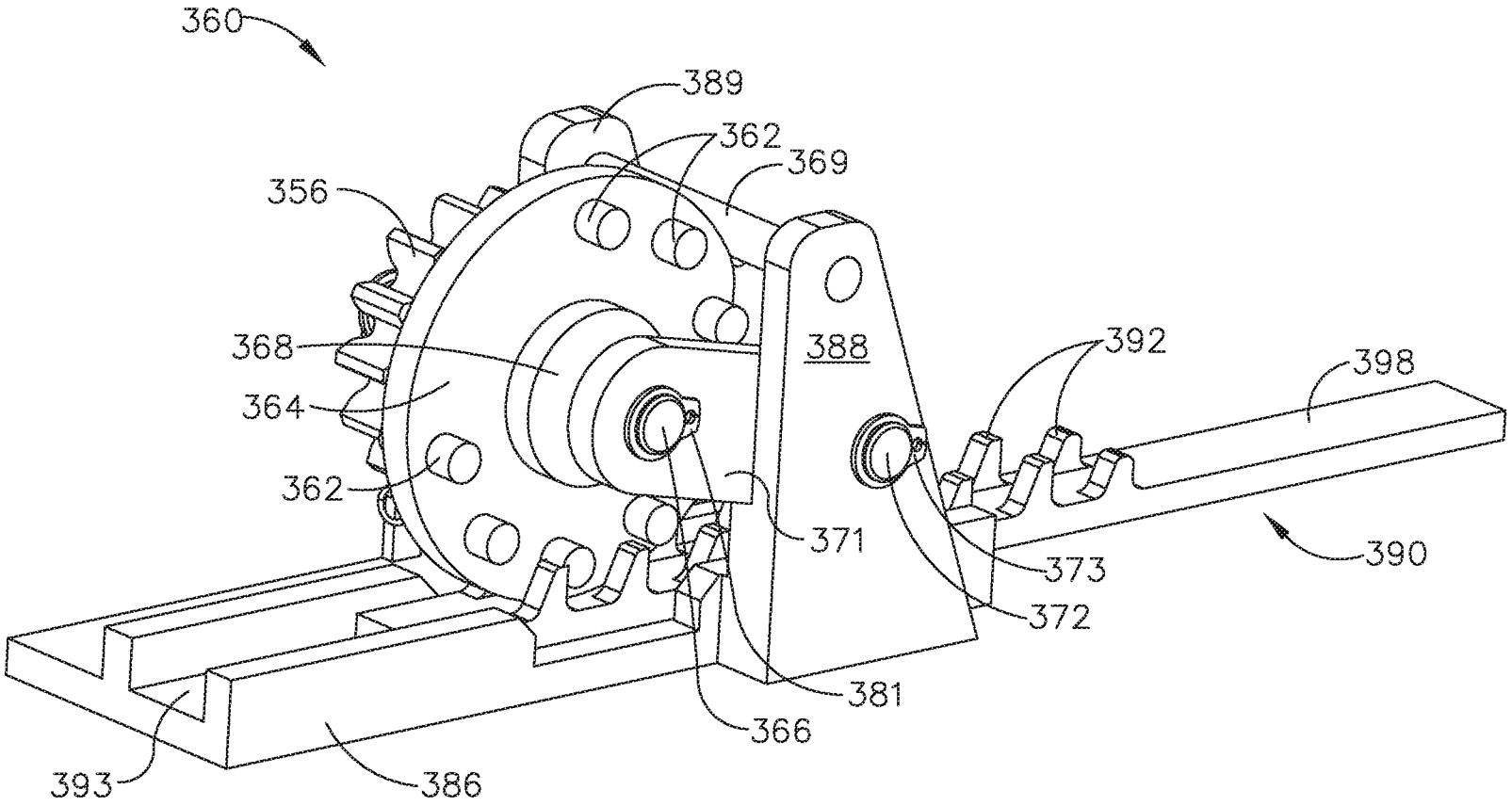
FIG. 22 is a perspective view of the fourth embodiment lifter subassembly of FIG. 21, showing the opposite side.

Referring now to FIGS. 21 and 22, a fourth embodiment of a lifter subassembly is illustrated, in which a lifter rotator is generally designated by the reference numeral 360. The lifter rotator 360 includes a single lifter disk 364, which is similar to the previously described disks 64 and 65 that are illustrated on FIG. 1. However, the lifter pins 363 of this fourth embodiment are arranged in a different manner than described above, since they are mounted on both sides of lifter disk 364.

Figure 24:
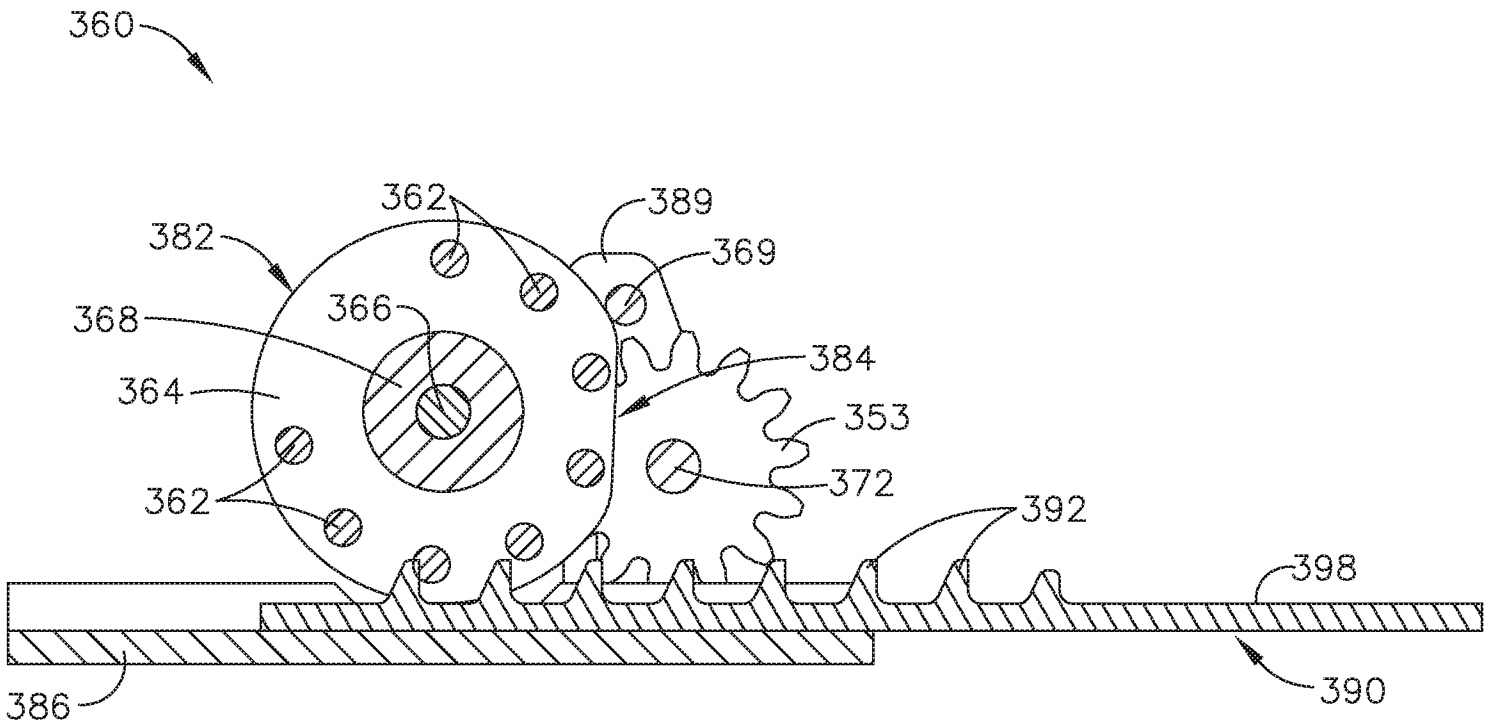
FIG. 24 is an elevational view in partial cross-section of the fourth embodiment lifter subassembly of FIG. 21, taken along the section line 24-24 on FIG. 23.

The lifter disk 364 exhibits an outer perimeter shape that has a cam profile, in which the round (arcuate) portion of the cam profile is designated at the reference numeral 382, and the flat (indented) portion of the cam profile is designated at the reference numeral 384—see FIG. 24. This cam profile is essentially identical to the cam profiles 82 and 84 on the lifter disks 64 and 65 of the first embodiment, as illustrated in FIGS. 1-14.

Some, or all, of the lifter pins 363 can have rollers installed thereon, if desired by the equipment designer. Such rollers are not specifically illustrated on FIGS. 21-24; however, in all cases, the lifter pins 362 and 363 may include such rollers.

The fourth embodiment lifter rotator 360 is illustrated as being positioned on a lifter shaft 366, which is mounted to a pair of pivot arms 370 and 371. The pivot arms 370 and 371 in turn are mounted to a pivot arm shaft 372, which is then mounted on a pair of parallel brackets 388 and 389. Two snap rings 381 and 383 are applied to the ends of the lifter shaft 366. The parallel brackets 388 and 389 are part of a lifter base 386, which includes a driver track 393. Two other snap rings 373 and 374 hold the pivot arm shaft 372 in place.

A driver 390 is movable within the driver track 393, and the driver has multiple teeth 392. A cam follower (or "retainer") 369 is mounted in the parallel brackets 388 and 389. As the rotator 360 rotates, the cam follower 369 will make contact with the curved (arcuate) portion 382 of the perimeter surface of the lifter disk 364, but will not make contact with the flat (indented) portion of the perimeter surface at 384.

The lifter shaft 366 is biased by an extension spring 380 so that, under normal circumstances, it causes the lifter pins 362 and 363 to be engaged against the driver teeth 392 of the driver 390. However, as described above in relation to the first embodiment of FIGS. 1-14, if the driver is stopped at a position that is out of specification, then one of the lifter pins may contact a driver tooth 392 at a position that will not successfully engage with that lifter pin. If that occurs, the pivot arms 370 and 371 will be allowed to displace (or pivot) away from the driver 390, and that will prevent a jam from occurring between the lifter rotator and the driver. In this regard, the overall lifter mechanism of the fourth embodiment works essentially the same as the overall lifter mechanism of the first embodiment.

In the "out of spec" event described in the previous paragraph, as the lifter continues to rotate, that "first" lifter pin 362/363 will be forced to "drop" into the gap between that initial driver tooth 392 and the "next" driver tooth 392. (See the contact point 77 on FIG. 12, for example.) At that point of the lifting phase, the continued rotation of the lifter rotator 360 will cause that "first" lifter pin to begin lifting the driver 390, due to physical contact between that "first" lifter pin 362/363 and the engaged "next" driver tooth 392. In this manner, the lifter rotator 360 will successfully force the driver 390 upward to create a complete lifting phase, while avoiding a jam condition from occurring.

There is a drive gear 353 that engages the lifter gear 356. The motion of the drive gear will cause the lifter rotator 360 to rotate, thereby forcing the driver 390 to move in a lifting phase, which will cause the driver to be moved to a "ready" position, where it can again drive a fastener from the fastener driving tool.

Figure 23:
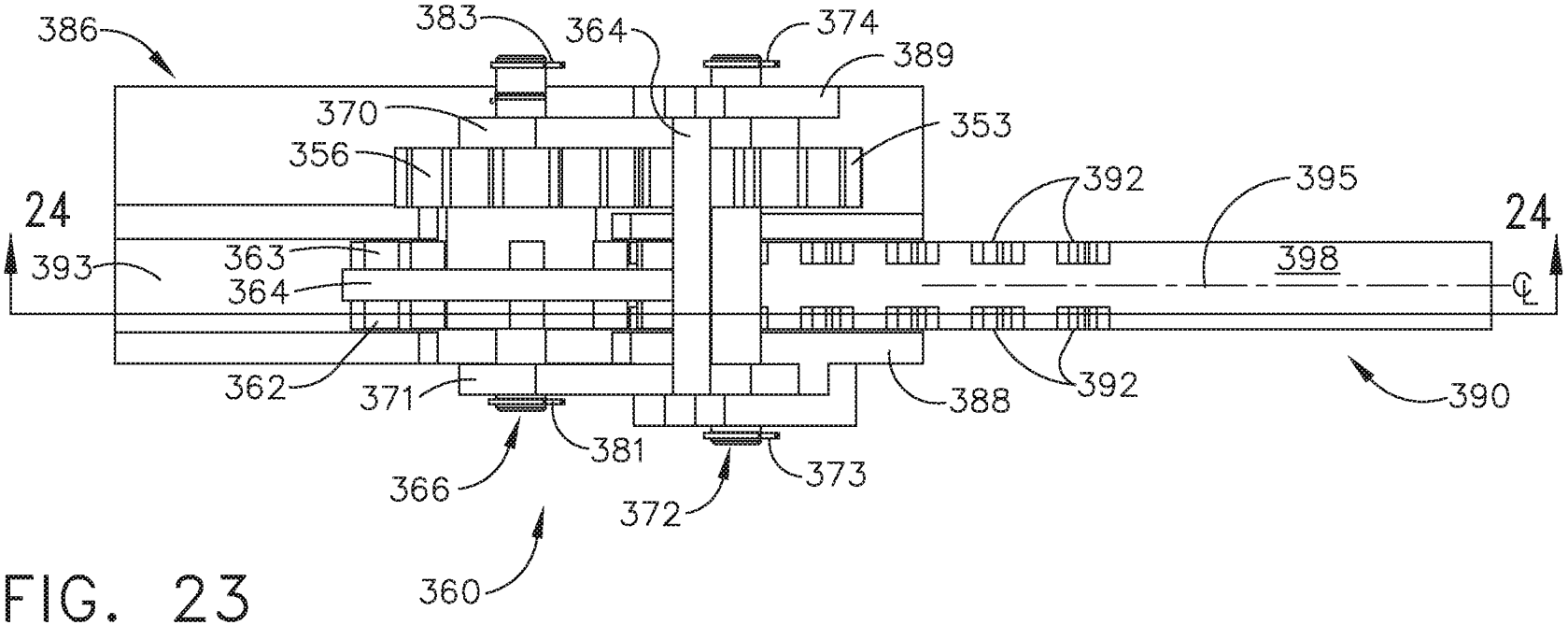
FIG. 23 is an elevational view of the fourth embodiment lifter subassembly of FIG. 21, showing the front of the lifter subassembly.

Referring now to FIG. 23, the fourth embodiment lifter is presented in an elevational view, which shows a lifter rotator 360 that includes the lifter disk 364, two different sets of lifter pins 362 and 363, and the lifter shaft 366, which runs through an opening in the lifter disk and also runs through a central opening of the lifter gear 356. A pair of snap rings 381 and 383 holds the lifter shaft 366 in place, and the extension spring 380 (see FIG. 21) biases the lifter shaft 366 toward the driver base 386.

The driver base 386 has a pair of extensions that act as the brackets 388 and 389. These brackets hold the cam follower ("retainer") 369 and also hold the pivot arm shaft 372 in position. Also mounted to the pivot arm shaft are the two parallel pivot arms 370 and 371, and the drive gear 353. A pair of snap rings 373 and 374 holds the pivot arm shaft 372 to the pivot arms 370 and 371.

The driver 390 is illustrated, which includes eight pairs of driver teeth 392 that extend from the driver's planar surface at 398. The driver 390 runs along a driver track 393 that is part of the lifter base 386. In this embodiment, the lifter disk 364 is positioned between the eight pairs of driver teeth 392. The two sets of lifter pins 362 and 363 are positioned to engage these pairs of driver teeth 392, as can be clearly seen in this view of FIG. 23. With the lifter disk 364 positioned along the longitudinal centerline 395 of the driver 390, and with the driver teeth 392 being positioned substantially equidistant from that same longitudinal centerline 395 of the driver 390, the arrangement of the two sets of lifter pins 362/363 will tend to substantially balance the mechanical loading forces on the driver 390 during a lifting phase.

Referring now to FIG. 24, the fourth embodiment lifter is presented in an elevational view from the side, which shows the lifter rotator 360 that includes the lifter disk 364. As noted above, the lifter disk has a cam profile, in which the round (arcuate) portion of the cam profile is designated at the reference numeral 382, and the flat (indented) portion of the cam profile is designated at the reference numeral 384. The lifter disk 364 is mated to lifter shaft 366 by a hub 368.

The embodiments described above each use a cam follower that acts as a retainer. In the first embodiment, the cam follower is reference numeral 69, whereas in the second embodiment the cam follower is reference numeral 169, in the third embodiment the cam follower is reference numeral 269, and in the fourth embodiment the cam follower is reference numeral 369. In all instances, the cam follower will not contact the outer surface of the lifter disks if the "flat" (indented) portion of the cam profile of those lifter disks is facing the cam follower. Only when the "round" (arcuate) portion of the cam profile of the lifter disk is facing the cam follower will physical contact be made between the cam follower and the lifter disk. At the beginning of each lifting phase, the flat (indented) portion of the cam profile of the lifter disks will be facing the cam follower, and therefore, that indented portion will allow the entire lifter rotator (60, 160, 260, or 360) to displace away from the driver teeth 92, 192, 292, or 392, if necessary. This occurs during a "first predetermined portion" of the lifting phase, which typically occurs quite near the beginning of a given lifting phase. As illustrated in FIGS. 9-14, that displacement can become necessary in a situation where the driver 90 stops at an undesirable position; but when that occurs with this new design, there will not be a jam because the lifter rotator is able to displace away from the driver.

As noted above, there can be other mechanical loading forces that may cause the lifter rotator to attempt to displace away from the driver at times where that displacement would be undesirable. One of those situations is during a transition phase that occurs after the driver has been "lifted" to its ready position. At the beginning of an operator actuation of the tool (to drive a fastener), the transition phase occurs, in which the "last" driver protrusion becomes the final protrusion to be contacted by one of the lifter pins 362 and 363 during the lifting phase. When that lifter pin 362 and 363 engages this final or "last tooth," there is no other driver tooth and no other lifter pin to accept some of the mechanical loading forces that occur on those parts, because these are the final engaging structures during the transition phase. When the "final" driver tooth and "last" lifter pin 362 and 363 are mechanically engaged, the force vectors can change to the point where the sideways (or horizontal) force becomes greater than the lift (or vertical) loading force, and this tends to force the movable portion of the lifter rotator 360 to displace away from the driver 390 about the pivot axis on pivot shaft 372. These loads need to be contained by the retainer 369 and by the contact face on at least one of the lifter disks (at the substantially round portion 382). That containment will prevent sudden movement by the movable portion of the lifter rotator 360, and it will provide an additional safety measure against a sudden driving of the tool's driver if the tool is dropped or otherwise bumped; this feature also generally provides for a reliable release position for the driving phase.

This "last" (or "final") lifter pin and this "last" driver tooth are mechanically engaged during the time the driver is at its "ready" position. However, at the beginning of a new transition phase (which will precede the next driving phase), the lifter rotator must again rotate in a manner that additionally lifts the driver 390 "upward" a small distance, before that "last" driver tooth is allowed to physically release from that "last" lifter pin. This transition phase of driver movement occurs at the beginning of every driving cycle, in the illustrated embodiments. At this transition phase, the force vectors can change to a point where the sideways (or horizontal) force becomes greater than the lift (or vertical) loading force, and this tends to force the lifter pivot arms to displace away from the driver. These loading forces need to be contained near the top of the driver's travel in the driver track, as discussed above.

The cam follower 369 on FIG. 21 will engage mechanically to make physical contact against the round (arcuate) portions 382 of the cam profile surfaces of the lifter disk 364 during this "second predetermined portion" of the lifting phase. This mechanical contact prevents the lifter rotator 360 from displacing away from the driver 390, thus preventing any kind of unfortunate (or accidental) firing of the driver that might be caused if the lifter rotator 360 would be allowed to displace away from the driver track at the end of a lifting phase. Due to these loading forces described above, the cam follower 369 acts as a retainer to hold the lifter rotator in its appropriate position during the transitional phase of the tool's operating cycle. The cam follower 369 can be allowed to rotate, if desired, so that it can "roll" over the "third contacting surface" of the arcuate perimeter 382 of the lifter disk.

It will be understood that, in situations where the driver has become mispositioned at the end of a driving phase—i.e., its stopping position is out of specification—then the "first" lifter pin will attempt to move past the "first" driver tooth that is encountered in a manner that will not cause a jam. If that lifter pin has no roller, then it will likely engage with that driver tooth in a sliding relationship (i.e., it will "slide along" the tooth) as it attempts to move past that first driver tooth. However, if that lifter pin does have a roller, then the lifter pin can engage with that driver tooth either in a sliding relationship or in a rolling relationship (i.e., it will "roll over" the tooth), as it attempts to move past that first driver tooth.

Figure 25:
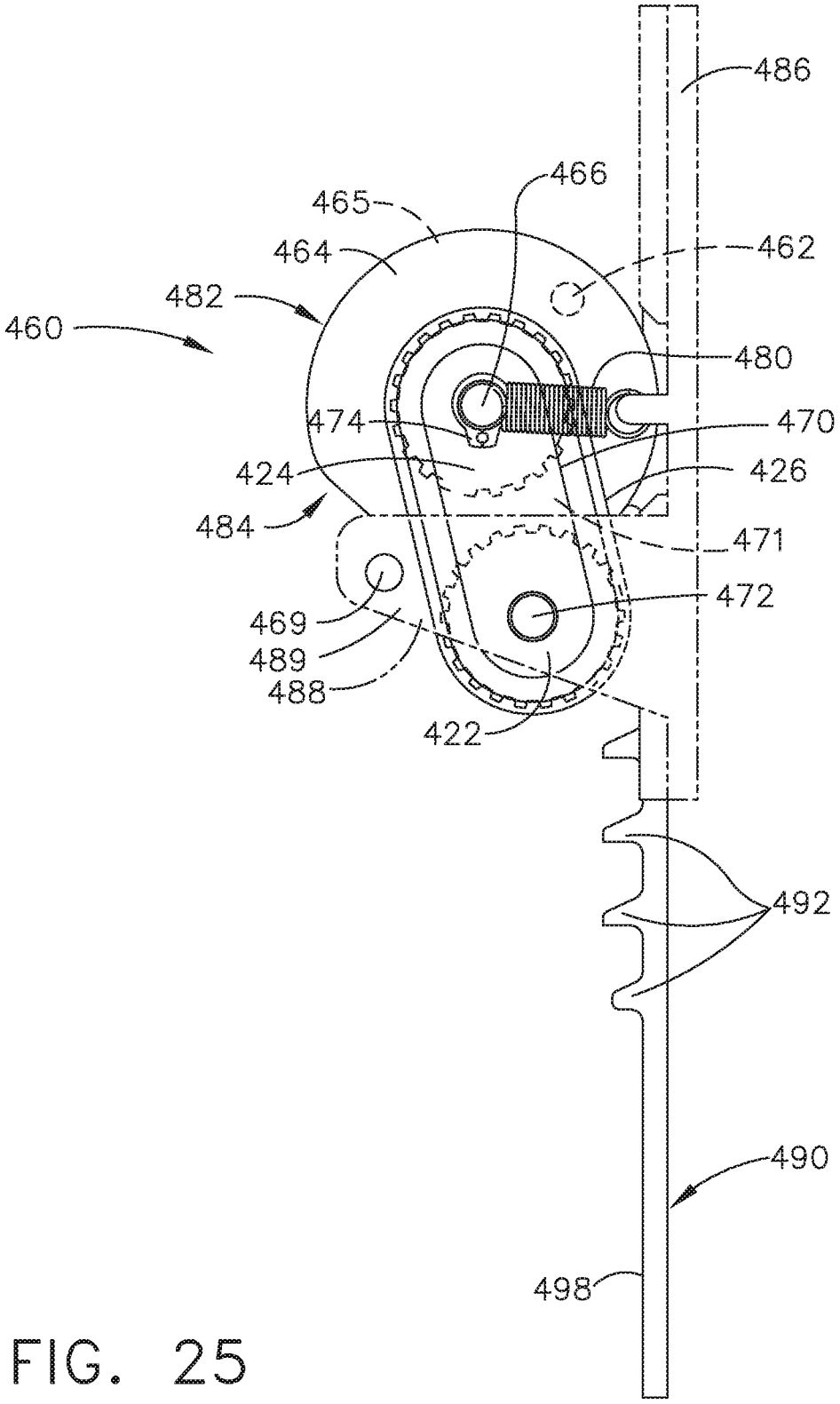
FIG. 25 is an elevational view in partial cross-section of a fifth embodiment lifter subassembly, which uses a belt and pulley system to drive the lifter rotator, as constructed according to the principles of the technology disclosed herein.

Referring now to FIG. 25, a fifth embodiment of a lifter subassembly is depicted in an elevational view in partial cross-section. A lifter rotator 460 is illustrated as being positioned on a lifter shaft 466, which is mounted to a pair of pivot arms 470 and 471 (directly behind pivot arm 470 in this view). The pivot arms 470 and 471 in turn are mounted to a pivot arm shaft 472, which is then mounted on a pair of parallel brackets 489 and 488 (directly behind bracket 489 in this view). The cam follower 469 is placed through two other openings in the brackets 488 and 489. The parallel brackets 488 and 489 are part of a lifter base 486, which includes a driver track.

An extension spring 480 is mounted between the lifter base 486 and the lifter shaft 466, so that the entire lifter subassembly is biased in a way that tends to hold the lifter rotator 460 against the driver 490. The driver 490 has eight pairs of driver teeth 492 which extend from the driver's planar surface at 498.

In this embodiment, a drive belt 426, lifter pulley 424, and drive pulley 422 are used to drive the lifter rotator 460. The lifter rotator 460 includes lifter disks 464 and 465 (directly behind disk 464 in this view). Two snap rings (not shown) are to be installed to the ends of the lifter shaft 466, and two other snap rings (not shown) are to be installed to the ends of the pivot arm shaft 472.

In FIG. 25 the lifter rotator 460 is positioned in its "engaged" position, which means that the lifter pins 462 will engage the driver teeth 492, so that the lifter disks 464 and 465, when rotated, will "lift" the driver 490 upward (in this view) to push the piston "up" (not shown) the cylinder of the driver fastener tool. These lifter pins 462 act as a "second contacting surface" that can engage the "first contacting surface" (e.g., the driver teeth). Also seen on FIG. 25, is a portion of the "cam profile" of the two lifter disks 464 and 465. As can be seen on FIG. 25, the lifter disk 464 has a "round" (arcuate) portion at 482, and a "flat" (indented) portion at 484.

This fifth embodiment lifter mechanism operates in a similar manner to that of the first embodiment lifter mechanism with respect to having a mechanical degree of freedom, as illustrated in FIGS. 9-14.

Some, or all, of the lifter pins 462 can have rollers installed thereon, if desired by the equipment designer. Such rollers are not specifically illustrated on FIG. 25; however, in all cases, the lifter pins 462 may include such rollers.

Figure 26:
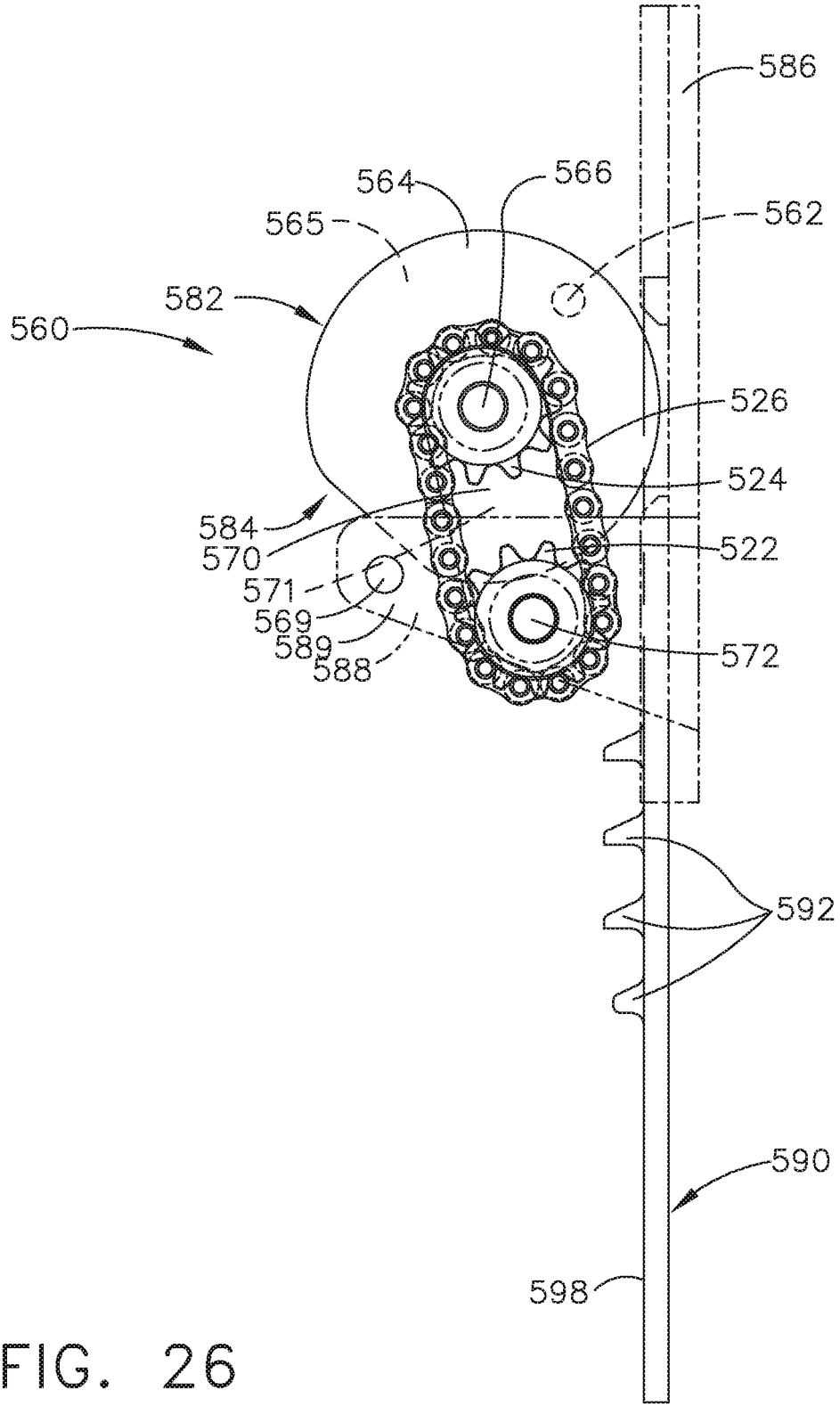
FIG. 26 is an elevational view in partial cross-section of a sixth embodiment lifter subassembly, which uses a chain and sprocket system to drive the lifter rotator, as constructed according to the principles of the technology disclosed herein.

Referring now to FIG. 26, a sixth embodiment of a lifter subassembly is depicted in an elevational view in partial cross-section. A lifter rotator 560 is illustrated as being positioned on a lifter shaft 566, which is mounted to a pair of pivot arms 570 and 571 (directly behind pivot arm 570 in this view). The pivot arms 570 and 571 in turn are mounted to a pivot arm shaft 572, which is then mounted on a pair of parallel brackets 589 and 588 (directly behind bracket 589 in this view). The cam follower 569 is placed through two other openings in the brackets 588 and 589. The parallel brackets 588 and 589 are part of a lifter base 586, which includes a driver track.

An extension spring (not shown) would be mounted between the lifter base 586 and the lifter shaft 566, so that the entire lifter subassembly will be biased in a way that tends to hold the lifter rotator 560 against the driver 590. The driver 590 has eight pairs of driver teeth 592 which extend from the driver's planar surface at 598.

In this embodiment, a drive chain 526, a lifter sprocket 524, and a drive sprocket 522 are used to drive the lifter rotator 560. The lifter rotator 560 includes lifter disk 564 and 565 (directly behind disk 564 in this view). Two snap rings (not shown) are to be installed to the ends of the lifter shaft 566, and two other snap rings (not shown) are to be installed to the ends of the pivot arm shaft 572.

In FIG. 26 the lifter rotator 560 is positioned in its "engaged" position, which means that the lifter pins 562 will engage the driver teeth 592, so that the lifter disks 564 and 565, when rotated, will "lift" the driver 590 upward (in this view) to push the piston "up" (not shown) the cylinder of the driver fastener tool. These lifter pins 562 act as a "second contacting surface" that can engage the "first contacting surface" (e.g., the driver teeth). Also seen on FIG. 26, is a portion of the "cam profile" of the two lifter disks 564 and 565. As can be seen on FIG. 26, the lifter disk 564 has a "round" (arcuate) portion at 582, and a "flat" (indented) portion at 584.

This sixth embodiment lifter mechanism operates in a similar manner to that of the first embodiment lifter mechanism with respect to having a mechanical degree of freedom, as illustrated in FIGS. 9-14.

Some, or all, of the lifter pins 562 can have rollers installed thereon, if desired by the equipment designer. Such rollers are not specifically illustrated on FIG. 26; however, in all cases, the lifter pins 562 may include such rollers.

It will be understood that any type of product described herein that has moving parts, or that performs functions (such as computers with processing circuits and memory circuits), should be considered a "machine," and not merely as some inanimate apparatus. Such "machine" devices should automatically include power tools, printers, electronic locks, and the like, as those example devices each have certain moving parts. Moreover, a computerized device that performs useful functions should also be considered a machine, and such terminology is often used to describe many such devices; for example, a solid-state telephone answering machine may have no moving parts, yet it is commonly called a "machine" because it performs well-known useful functions.

As used herein, the term "proximal" can have a meaning of closely positioning one physical object with a second physical object, such that the two objects are perhaps adjacent to one another, although it is not necessarily required that there be no third object positioned therebetween. In the technology disclosed herein, there may be instances in which a "male locating structure" is to be positioned "proximal" to a "female locating structure." In general, this could mean that the two male and female structures are to be physically abutting one another, or this could mean that they are "mated" to one another by way of a particular size and shape that essentially keeps one structure oriented in a predetermined direction and at an X-Y (e.g., horizontal and vertical) position with respect to one another, regardless as to whether the two male and female structures actually touch one another along a continuous surface. Or, two structures of any size and shape (whether male, female, or otherwise in shape) may be located somewhat near one another, regardless if they physically abut one another or not; such a relationship could still be termed "proximal." Or, two or more possible locations for a particular point can be specified in relation to a precise attribute of a physical object, such as being "near" or "at" the end of a stick; all of those possible near/at locations could be deemed "proximal" to the end of that stick. Moreover, the term "proximal" can also have a meaning that relates strictly to a single object, in which the single object may have two ends, and the "distal end" is the end that is positioned somewhat farther away from a subject point (or area) of reference, and the "proximal end" is the other end, which would be positioned somewhat closer to that same subject point (or area) of reference.

It will be understood that the various components that are described and/or illustrated herein can be fabricated in various ways, including in multiple parts or as a unitary part for each of these components, without departing from the principles of the technology disclosed herein. For example, a component that is included as a recited element of a claim hereinbelow may be fabricated as a unitary part; or that component may be fabricated as a combined structure of several individual parts that are assembled together. But that "multi-part component" will still fall within the scope of the claimed, recited element for infringement purposes of claim interpretation, even if it appears that the claimed, recited element is described and illustrated herein only as a unitary structure.

Note that the embodiments illustrated herein do not have their outer housings included on any of the figures herein, for purposes of clarity. To see examples of such outer housings and other components, the reader is directed to other U.S. patents and applications owned by Senco. Moreover, other aspects of the present technology may have been present in earlier fastener driving tools sold by the Assignee, Senco, including information disclosed in previous U.S. patents and published applications. Examples of such publications are U.S. Pat. Nos. 6,431,425; 5,927,585; 5,918,788; 5,732,870; 4,986,164; 4,679,719; 8,011,547, 8,267,296, 8,267,297, 8,011,441, 8,387,718, 8,286,722, 8,230,941, and 8,763,874; also published U.S. patent application, No. 2016/0288305. These documents are incorporated by reference herein, in their entirety.

All documents cited in the Background and in the Detailed Description are, in relevant part, incorporated herein by reference; the citation of any document is not to be construed as an admission that it is prior art with respect to the technology disclosed herein.

The foregoing description of a preferred embodiment has been presented for purposes of illustration and description. It is not intended to be exhaustive or to limit the technology disclosed herein to the precise form disclosed, and the technology disclosed herein may be further modified within the spirit and scope of this disclosure. Any examples described or illustrated herein are intended as non-limiting examples, and many modifications or variations of the examples, or of the preferred embodiment(s), are possible in light of the above teachings, without departing from the spirit and scope of the technology disclosed herein. The embodiment(s) was chosen and described in order to illustrate the principles of the technology disclosed herein and its practical application to thereby enable one of ordinary skill in the art to utilize the technology disclosed herein in various embodiments and with various modifications as are suited to particular uses contemplated. This application is therefore intended to cover any variations, uses, or adaptations of the technology disclosed herein using its general principles. Further, this application is intended to cover such departures from the present disclosure as come within known or customary practice in the art to which this technology disclosed herein pertains and which fall within the limits of the appended claims.

What is claimed is:

1. A driving apparatus for use in a fastener driving tool, said driving apparatus comprising:

(a) a guide body that receives a fastener that is to be driven from an exit end of the guide body;

(b) an elongated driver having a first end that is sized and shaped to push a fastener from said exit end, said driver having a second, opposite end, said driver having a direction of movement along a driver track of said guide body, said driver exhibiting a first contacting surface located between said first end and said second end, said driver having a ready position that is distal from said exit end, and said driver having a driven position that is proximal to said exit end;

(c) a movable arm that exhibits a proximal end and a distal end, said proximal end being in communication with said guide body and said distal end having a rotator mounted thereto, said rotator including a second contacting surface, said movable arm being movable between a first position and a second position, said movable arm being biased toward said first position, said movable arm having a mechanical freedom of movement toward said second position, and if said movable arm is in said first position, then said second contacting surface of the rotator is in an engagement position with respect to said first contacting surface of the driver; and (d) a retainer that physically contacts a third contacting surface of said rotator during at least a portion of a transition phase of a movement cycle, but that does not physically contact said third contacting surface of said rotator during a predetermined portion of a lifting phase of said movement cycle;

(e) wherein:

(i) during said predetermined portion of said lifting phase, said second contacting surface of the rotator attempts to physically contact said first contacting surface of the driver and thus cause said driver to move toward said ready position;

(ii) during said predetermined portion of said lifting phase, if said driver and said rotator are misaligned, such that said first contacting surface cannot be properly contacted by said second contacting surface, then the mechanical freedom of movement of said movable arm allows said rotator to displace toward said second position, which allows said second contacting surface to move past the misaligned first contacting surface without jamming; and (iii) during a first portion of said transition phase, if mechanical loading forces upon said rotator tend to separate said second contacting surface of the rotator from said first contacting surface of the driver, then physical contact between said retainer and said third contacting surface of said rotator prevents said rotator from displacing toward said second position.

2. The driving apparatus of claim 1, wherein: during said driving phase, said second contacting surface of the rotator is at a non-interfering position with respect to said first contacting surface of the driver, thereby allowing said driver to quickly move toward said driven position, even though the rotator is still prevented from displacing.

3. The driving apparatus of claim 1, wherein: said movable arm is pivotally mounted to said guide body at said proximal end.

4. The driving apparatus of claim 1, wherein: said rotator includes at least one rotatable disk that exhibits a cam profile along its outer perimeter edge, said cam profile comprising a first portion that is arcuate in shape, and a second portion that is indented, wherein said arcuate first portion comprises said third contacting surface of said rotator, and said indented second portion provides a gap between said outer perimeter edge of the rotatable disk and said retainer, thereby putting into effect said mechanical freedom of movement of said movable arm, and thereby allowing said movable arm to displace toward said second position.

5. The driving apparatus of claim 1, wherein: during a first portion of said transition phase, the physical contact between said retainer and said third contacting surface of said rotator also prevents a separation from occurring between said second contacting surface of the rotator and said first contacting surface of the driver.

6. The driving apparatus of claim 1, wherein:

(a) said first contacting surface of the driver comprises a plurality of spaced-apart protrusions along at least one surface of the driver; and (b) said second contacting surface of the rotator comprises a plurality of extensions extending from a surface of at least one rotatable disk.

7. The driving apparatus of claim 6, wherein if said second contacting surface is moving past the misaligned first contacting surface, then one of said rotator extensions is sliding along one of said protrusions of the driver.

8. The driving apparatus of claim 6, wherein if said second contacting surface is moving past the misaligned first contacting surface, then a roller on one of said rotator extensions is rolling over one of said protrusions of the driver.

9. The driving apparatus of claim 6, wherein if a first one of said plurality of extensions is initially misaligned with respect to a first one of said plurality of spaced-apart protrusions, then, as said rotator continues rotating for said lifting phase, the first one of said plurality of extensions will slip into a gap between said first one of said plurality of spaced-apart protrusions and a second one of said plurality of spaced-apart protrusions, and then the first one of said plurality of extensions will physically contact the second one of said plurality of spaced-apart protrusions to begin moving said driver.

10. The driving apparatus of claim 1, further comprising:

(a) an electric motor that provides rotational energy for said rotator; and (b) a piston that provides linear energy for said driver.

11. The driving apparatus of claim 1, wherein:

said rotator comprises at least one rotatable disk that exhibits an outer perimeter that has a cam profile, in which said cam profile includes a first portion of the outer perimeter having an arcuate shape, and a second portion of the outer perimeter having an indented shape, such that:

(a) said indented shape of said at least one rotatable disk is proximal to said retainer during the first predetermined portion of said lifting phase, and there is a separation between the retainer and said perimeter of said at least one rotatable disk, thereby allowing said rotator to displace toward said second position;

(b) said arcuate shape of said at least one rotatable disk is proximal to said retainer during the second predetermined portion of said lifting phase, and there is physical contact between the retainer and said perimeter of said at least one rotatable disk, thereby preventing said rotator from displacing toward said second position.

12. The driving apparatus of claim 1, wherein: during a second portion of said transition phase, further rotational movement of said rotator causes said second contacting surface of the rotator to release from physical contact with said first contacting surface of the driver while the rotator is still prevented from displacing toward said second position, and the driver enters into a driving phase of said movement cycle.

13. A driving apparatus for use in a fastener driving tool, said driving apparatus comprising:

(a) a guide body that receives a fastener that is to be driven from an exit end;

(b) an elongated driver having a first end that is sized and shaped to push a fastener from said exit end, said driver having a second, opposite end, said driver having a direction of movement along a driver track of said guide body, said driver including a plurality of protrusions along at least one surface of the driver between said first end and said second end, wherein said plurality of protrusions are substantially equidistant from a centerline of the driver along its direction of movement, said driver having a ready position that is distal from said exit end, said driver having a driven position that is proximal to said exit end; and (c) a rotator which includes at least one rotatable disk, said at least one rotatable disk having a plurality of lifter extensions extending from at least one surface of said at least one rotatable disk, said plurality of lifter extensions being movable to an engagement position with respect to said plurality of protrusions of the driver;

(d) wherein, for moving said driver toward said ready position:

(i) said at least one rotatable disk rotates in a first direction, and (ii) a rotational movement of said plurality of lifter extensions engage with said plurality of spaced-apart protrusions in a manner that substantially balances mechanical loading forces on said driver during a lifting phase toward said ready position.

14. The driving apparatus of claim 13, wherein: said driver protrusions are arranged in pairs, such that each driver protrusion located on one side of said centerline of the driver has a substantially identical driver protrusion in size and shape located on the other side of said centerline of the driver.

15. The driving apparatus of claim 13, wherein: said rotator comprises a single rotatable disk having: (a) a first plurality of lifter extensions extending from a first surface of said rotatable disk, and (b) a second plurality of lifter extensions extending from a second surface of said rotatable disk.

16. The driving apparatus of claim 13, wherein: said rotator comprises at least two rotatable disks that rotate together, said at least two rotatable disks having a plurality of lifter extensions extending from a surface of said at least two rotatable disks, said plurality of lifter extensions being in an engagement position with respect to said plurality of protrusions of the driver, if said driver has moved to a driven position that is proximal to said second end travel location.

17. The driving apparatus of claim 16, wherein: each of said plurality of lifter extensions extends all the way from a first one of said at least two rotatable disks to a second one of said at least two rotatable disks, and said plurality of lifter extensions engage both driver protrusions of each of the pairs of said driver protrusions with substantially equal force.

18. The driving apparatus of claim 16, wherein: each of said plurality of lifter extensions extends only part way from a first one of said at least two rotatable disks to a second one of said at least two rotatable disks, and a first of said plurality of lifter extensions extending from said first one of the at least two rotatable disks engages one of the driver protrusions of each of the pairs of said driver protrusions with a first force, and a second of said plurality of lifter extensions extending from said second one of the at least two rotatable disks engages one of the driver protrusions of each of the pairs of said driver protrusions with a second force, such that said first force is substantially equal to said second force.

19. The driving apparatus of claim 16, wherein: said at least two rotatable disks comprise one of:

(a) at least two disks, each having an outer perimeter with a smooth outer surface that allows a retainer to slide along said smooth outer surface without fouling;

(b) at least two disks, each having an outer perimeter with a smooth outer surface that allows a retainer to roll over said smooth outer surface without fouling;

(c) at least two disks, in which at least one disk has an outer perimeter with a smooth outer surface that allows a retainer to slide along said smooth outer surface without fouling, and in which at least one other disk has an outer perimeter that comprises external gear teeth; and (d) at least two disks, in which at least one disk has an outer perimeter with a smooth outer surface that allows a retainer to roll over said smooth outer surface without fouling, and in which at least one other disk has an outer perimeter that comprises external gear teeth.

20. A driving apparatus for use in a fastener driving tool, said driving apparatus comprising:

(a) a guide body that receives a fastener that is to be driven from an exit end;

(b) an elongated driver having a first end that is sized and shaped to push a fastener from said exit end, said driver having a second, opposite end, said driver being movable along a driver track in said guide body, said driver including a plurality of protrusions along at least one surface, said driver having a ready position that is distal from said exit end, and said driver having a driven position that is proximal to said exit end;

(c) a movable arm that exhibits a proximal end and a distal end, said proximal end being in communication with said guide body, said distal end having at least one rotatable disk mounted thereto, said at least one rotatable disk including a plurality of extensions that extend from at least one surface of said at least one rotatable disk, said at least one rotatable disk having an outer perimeter having a predetermined shape, in which a first portion of said outer perimeter is arcuate, and a second portion is indented, said movable arm being movable between a first position and a second position, said movable arm being biased toward said first position, said movable arm having a mechanical freedom of movement toward said second position, and if said movable arm is in said first position, then at least one of said plurality of extensions is configured to make physical contact with at least one of said plurality of protrusions of said driver; and (d) a retainer that physically contacts a said arcuate first portion of the outer perimeter of said at least one rotatable disk during at least a portion of a transition phase of a movement cycle, but that does not physically contact said indented second portion of the outer perimeter of said at least one rotatable disk during a predetermined portion of a lifting phase of said movement cycle;

(e) wherein:

(i) during said predetermined portion of said lifting phase, said plurality of extensions of said at least one rotatable disk attempts to physically contact said plurality of protrusions of the driver and thus cause said driver to move toward said ready position;

(ii) during said predetermined portion of said lifting phase, if said driver and said at least one rotatable disk are misaligned, such that said plurality of protrusions cannot be properly contacted by said plurality of extensions, then the mechanical freedom of movement of said movable arm allows said at least one rotatable disk to displace toward said second position, which allows said plurality of extensions to move past the misaligned plurality of protrusions without jamming; and (iii) during a first portion of said transition phase, if mechanical loading forces upon said at least one rotatable disk tend to separate said plurality of extensions of said at least one rotatable disk from said plurality of protrusions of the driver, then physical contact between said retainer and said outer perimeter of said at least one rotatable disk of said at least one rotatable disk prevents said at least one rotatable disk from displacing toward said second position.

21. The driving apparatus of claim 20, wherein: said at least one rotatable disk comprises a drive pulley, a lifter pulley, and a drive belt.

22. The driving apparatus of claim 20, wherein: said at least one rotatable disk comprises a drive sprocket, a lifter sprocket, and a drive chain.

23. The driving apparatus of claim 20, wherein: said at least one rotatable disk comprises a disk that has an outer perimeter that comprises external gear teeth.

24. The driving apparatus of claim 20, wherein: during a second portion of said transition phase, further rotational movement of said at least one rotatable disk causes said plurality of extensions of said at least one rotatable disk to release from physical contact with said plurality of protrusions of the driver while said at least one rotatable disk is still prevented from displacing toward said second position, and the driver enters into a driving phase of said movement cycle.

25. The driving apparatus of claim 20, wherein if a first one of said plurality of extensions is initially misaligned with respect to a first one of said plurality of spaced-apart protrusions, then, as said rotator continues rotating for said lifting phase, the first one of said plurality of extensions will slip into a gap between said first one of said plurality of spaced-apart protrusions and a second one of said plurality of spaced-apart protrusions, and then the first one of said plurality of extensions will physically contact the second one of said plurality of spaced-apart protrusions to begin moving said driver.

* * * * *